US007766449B2

(12) United States Patent
Watanabe

(10) Patent No.: US 7,766,449 B2
(45) Date of Patent: Aug. 3, 2010

(54) INK-JET RECORDING APPARATUS

(75) Inventor: Hidetoshi Watanabe, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 646 days.

(21) Appl. No.: 11/692,118

(22) Filed: Mar. 27, 2007

(65) Prior Publication Data

US 2008/0278537 A1 Nov. 13, 2008

(30) Foreign Application Priority Data

Mar. 27, 2006 (JP) ..... 2006-084643
Mar. 27, 2006 (JP) ..... 2006-084644

(51) Int. Cl.
*B41J 2/165* (2006.01)

(52) U.S. Cl. ..... 347/29; 347/32; 347/33

(58) Field of Classification Search ..... 347/29, 347/30, 32, 33
See application file for complete search history.

(56) References Cited

U.S. PATENT DOCUMENTS

| | | | | |
|---|---|---|---|---|
| 6,511,152 | B2 * | 1/2003 | Yoshimura | 347/33 |
| 6,578,945 | B2 * | 6/2003 | Hashi et al. | 347/22 |
| 6,866,361 | B2 | 3/2005 | Kuki et al. | |

FOREIGN PATENT DOCUMENTS

| | | | |
|---|---|---|---|
| JP | H11-020187 | A | 1/1999 |
| JP | 2003-001855 | A | 1/2003 |
| JP | 2004142450 | A | 5/2004 |
| JP | 2004-160760 | A | 6/2004 |

OTHER PUBLICATIONS

Japan Patent Office; Notice of Reasons for Rejection in Japanese Patent Application No. 2006-084644 (counterpart to The above-captioned U.S. patent application) mailed Sep. 8, 2009 (abridged translation).

* cited by examiner

*Primary Examiner*—Shih-Wen Hsieh
(74) *Attorney, Agent, or Firm*—Baker Botts L.L.P.

(57) ABSTRACT

An ink-jet recording apparatus includes an ink-jet head having an ink ejection surface which has a plurality of ink ejection ports formed therethough, and a cap including a base, and an annular protrusion which extends from the base in a protruding direction. The annular protrusion has a recess formed therein, and when the annular protrusion contacts the ink ejection surface, an enclosed space is defined therebetween. The apparatus also includes a first movement mechanism configured to move the cap relative to the ink-jet head in a first plane which is parallel to the ink ejection surface to selectively position the annular protrusion in a first position in which the annular protrusion opposes the ink ejection surface, and a second position in which the annular protrusion is offset from the ink ejection surface in the protruding direction. Moreover, the apparatus includes a brush comprising a plurality of flexible needle members.

29 Claims, 20 Drawing Sheets

INK-JET RECORDING APPARATUS

CROSS-REFERENCE TO RELATED APPLICATION

This application claims priority to and the benefit of Japanese Patent Application Nos. 2006-084643 and 2006-084644, which were filed on Mar. 27, 2006, the disclosures of which are incorporated herein by reference.

BACKGROUND OF THE INVENTION

1. Field of the Invention

The present invention relates generally to an ink-jet recording apparatus which ejects ink onto a recording medium.

2. Description of Related Art

A known ink-jet recording apparatus, such as the ink-jet recording apparatus described in Japanese Patent Unexamined Publication No. 2004-142450 includes a maintenance unit which includes a blade, a wipe roller, an ink receiving member, and a purge cap. The maintenance unit performs a suction purge while the purge cap covers an ink ejection surface, i.e., the maintenance unit applies a suction force to a nozzle thereby drawing nozzle powder dust, ink containing air bubbles, thickened ink, and the like, from the nozzle. Subsequently, ink adhering to the nozzle face is removed off by means of the ink receiving member, the wipe roller, and the blade.

SUMMARY OF THE INVENTION

A need has arisen from ink-jet recording apparatus which overcome these and other shortcomings of the related art.

According to an embodiment of the present invention, An ink-jet recording apparatus comprises an ink-jet head having an ink ejection surface which has a plurality of ink ejection ports formed therethough, and a cap including a base, and an annular protrusion which extends from the base in a protruding direction. The annular protrusion has a recess formed therein, and when the annular protrusion contacts the ink ejection surface, an enclosed space is defined therebetween. The apparatus also comprises a first movement mechanism configured to move the cap relative to the ink-jet head in a first plane which is parallel to the ink ejection surface to selectively position the annular protrusion in a first position in which the annular protrusion opposes the ink ejection surface, and a second position in which the annular protrusion is offset from the ink ejection surface in the protruding direction. Moreover, the apparatus comprises a brush comprising a plurality of flexible needle members.

According to another embodiment of the present invention, an ink-jet recording apparatus comprises an ink-jet head having an ink ejection surface which has a plurality of ink ejection ports formed therethough, and a cap comprising a base and an annular protrusion which extends from the base in a protruding direction. The annular protrusion has a recess formed therein, and when the annular protrusion contacts the ink ejection surface, an enclosed space is defined therebetween. The apparatus also comprises a wiper configured to wipe the ink ejection face, and a first movement mechanism configured to move the cap relative to the ink-jet head in a first plane which is parallel to the ink ejection surface to selectively position the annular protrusion in a first position in which the annular protrusion opposes the ink ejection surface, and a second position in which the annular protrusion and the wiper are offset from the ink ejection surface in the protruding direction. Moreover, when the annular protrusion is in the second position the annular protrusion and the wiper are offset from the ink ejection surface in the protruding direction, and when the annular protrusion is in an intermediate position between the first position and the second portion the annular protrusion is offset from the ink ejecting surface in the protruding direction and the wiper contacts the ink ejection surface to wipe the ink ejection surface. The apparatus further comprises at least one covering configured to selectively cover the cap and the wiper, and a second movement mechanism configured to move at least one of the cap and the covering in the protruding direction, such that the at least one covering covers the cap and the wiper when the annular protrusion is in the second position.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-20, like numerals being used for like corresponding portions in the various drawings.

Figure 1:
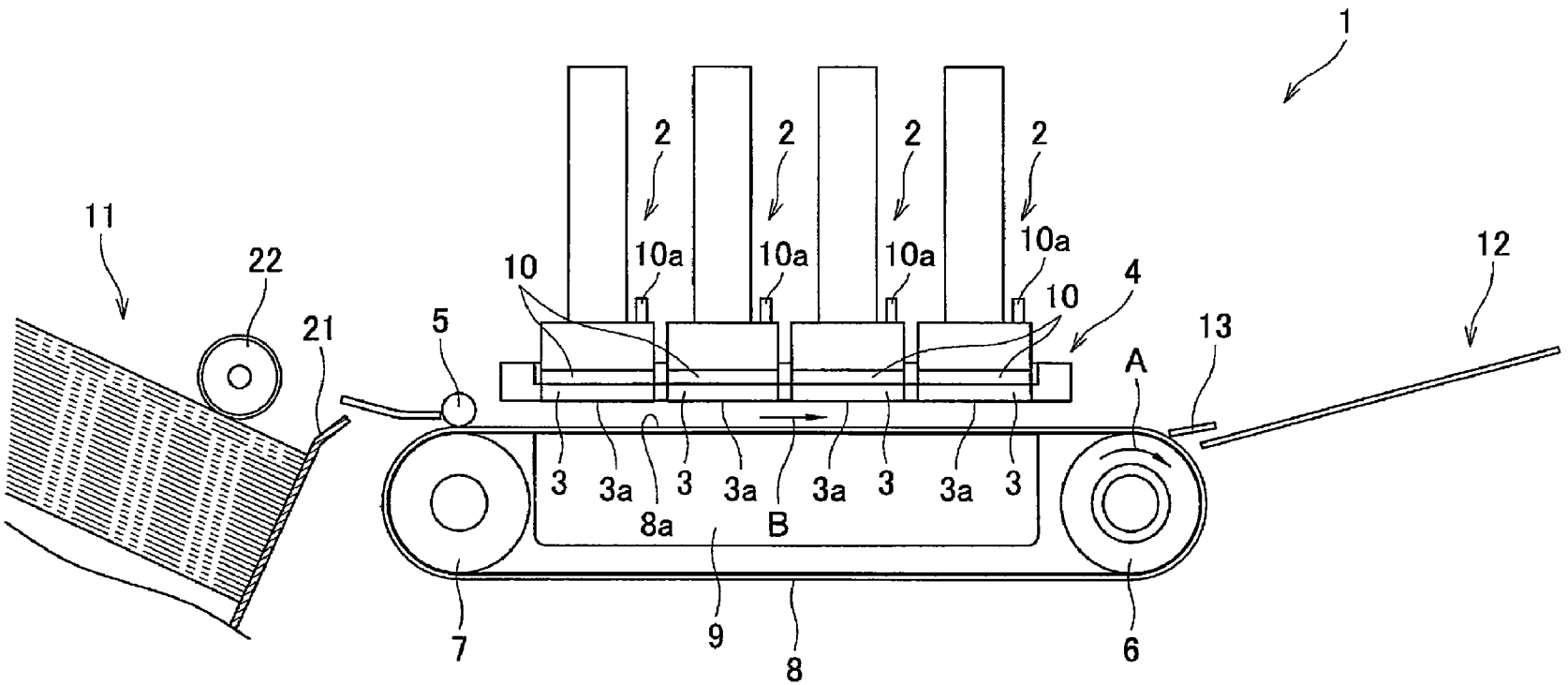
FIG. 1 is a side, cross-section of an ink-jet printer, according to an embodiment of the present invention.

Referring to FIG. 1, an ink-jet printer 1 according to an embodiment of the present invention is depicted. Ink-jet printer 1 may be a color ink-jet printer and may comprise a plurality of, e.g., four, ink-jet heads 2. The inkjet printer 1 may comprise a paper feeder 11, a paper discharger 12, and a maintenance unit 70 positioned behind the ink-jet heads 2.

Figure 9:
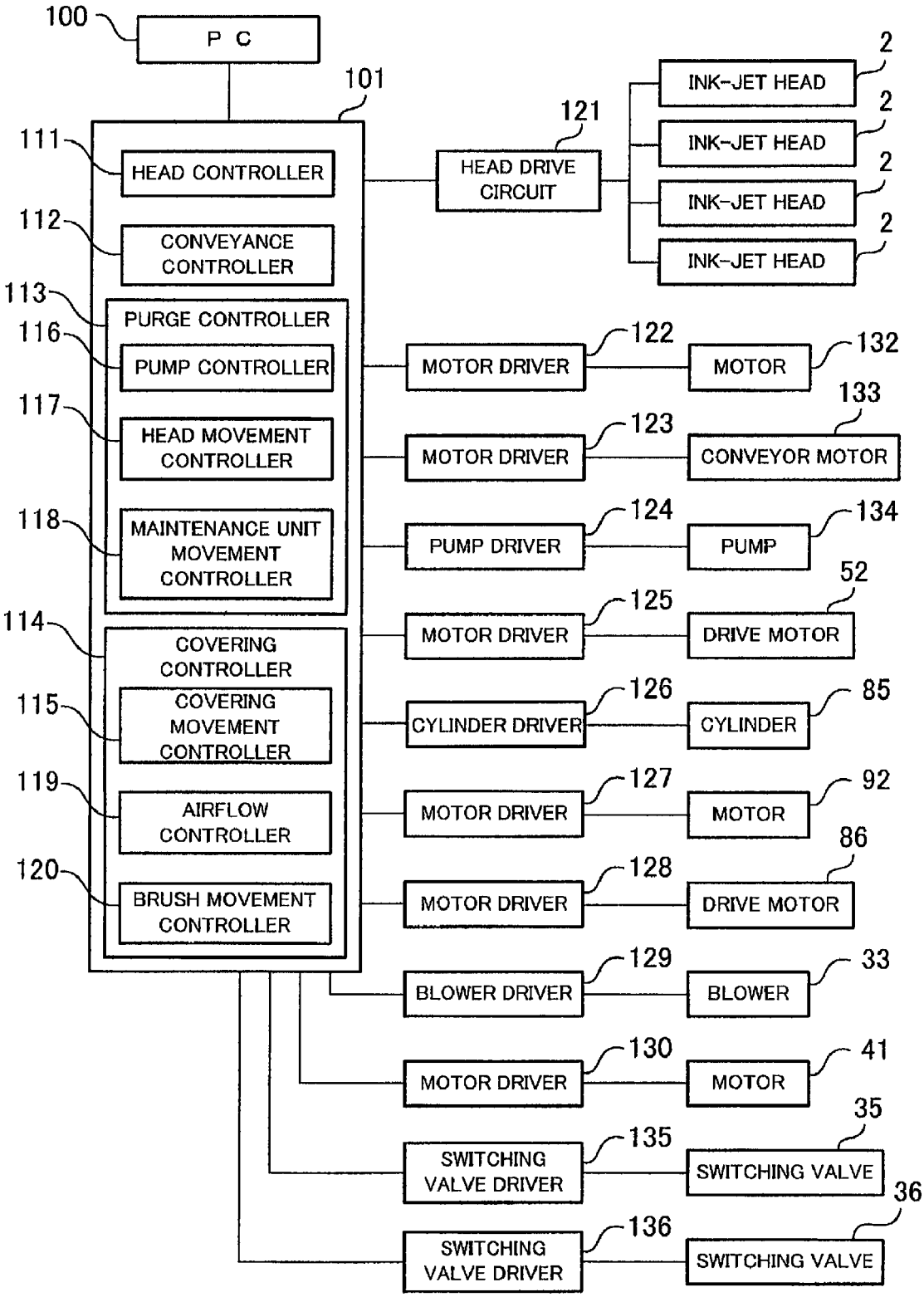
FIG. 9 is a schematic block diagram showing a control system of the ink-jet printer of FIG. 1.

A paper conveyance path may be formed inside the ink-jet printer 1, and a recording medium, such as paper, may be conveyed from the paper feeder 11 toward the paper discharger 12 via the paper conveyance path. The paper feeder 11 may comprise a pick-up roller 22 configured to feed an uppermost one of the recording medium accommodated within a paper tray 21. Referring to FIGS. 1 and 9, when a motor 132 drives the pick-up roller 22, a recording medium is fed from left to right in FIG. 1. Two belt rollers 6 and 7, and an endless conveyor belt 8, may be positioned within the paper conveyance path, and a paper conveyance mechanism may comprise belt rollers 6 and 7 and endless conveyer belt 8. The endless conveyor belt 8 may be wound on the rollers 6 and 7 and may be stretched therebetween. As indicated by the arrow A, the belt roller 6 may rotate clockwise via a driving force transmitted by a conveyor motor 133. An outer circumferential surface 8*a* of the conveyor belt 8 may be treated with silicone to have adhesive qualities. A press roller 5 may be positioned downstream of the paper feeder 11 and may oppose the conveyor belt 8. The press roller 5 may transmit a recording medium which has been fed from the paper feeder 11 onto the conveyor face 8*a* of the conveyor belt 8. The recording medium fed onto the conveyor face 8*a* then may be conveyed downstream and remain on the conveyor face 8*a* due to the adhesiveness of the conveyor face 8*a*.

A peeling plate 13 may be positioned downstream of the conveyor belt 8 with respect to the paper conveyance direction. The peeling plate 13 may remove a recording medium which is positioned on the conveyor face 8*a* from the conveyor face 8*a*, and may feed the paper to the paper discharger 12.

A platen 9 may have a substantially rectangular-parallelepiped shape and may be enclosed by the conveyor belt 8. The platen 9 may oppose the ink-jet heads 2, and may contact a lower surface of an upper half of the conveyor belt 8 to support the conveyor belt 8 from an inner circumferential side of the conveyor belt 8.

Figure 2:
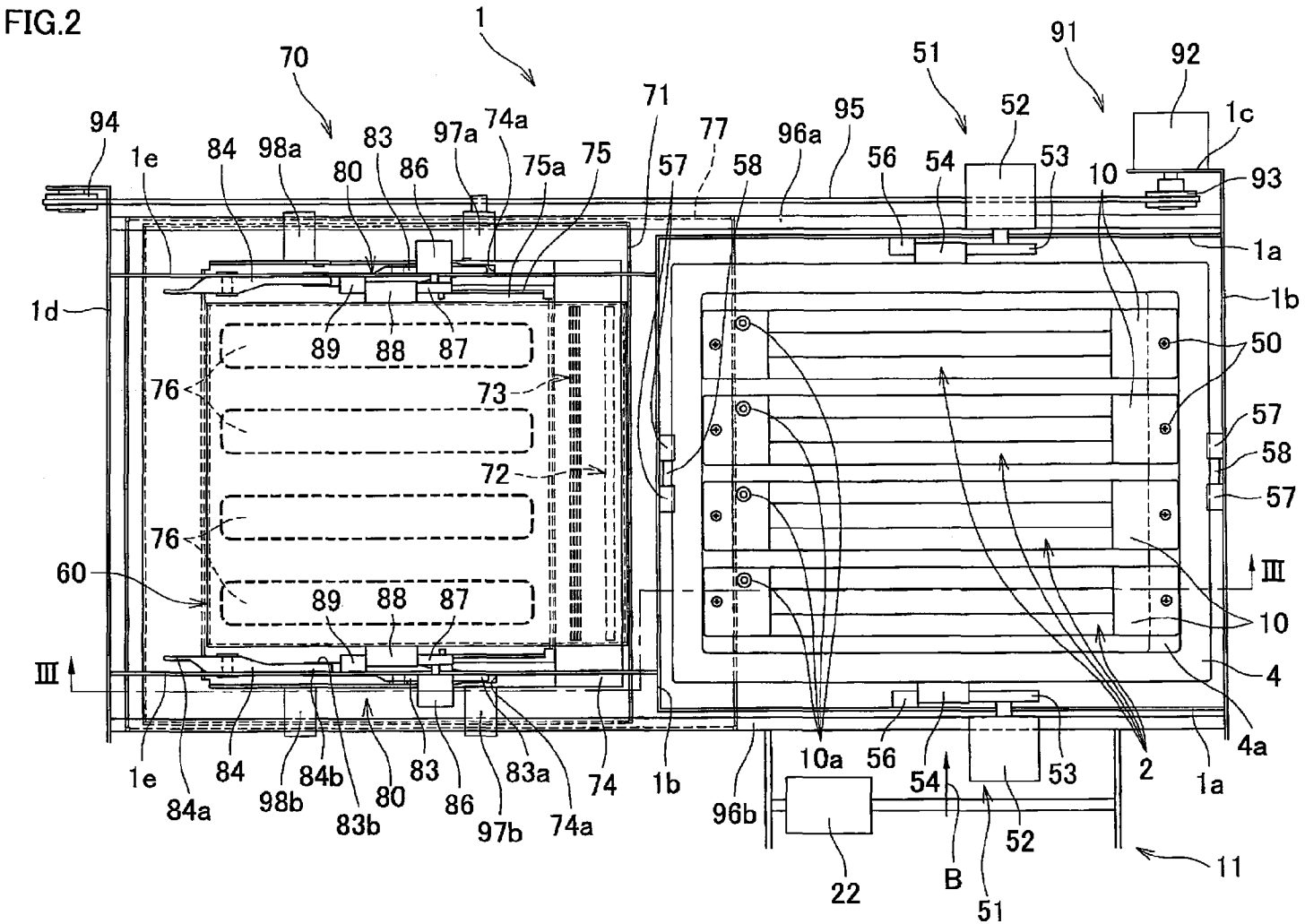
FIG. 2 is a plan view of the ink-jet printer of FIG. 1.
Figure 3:
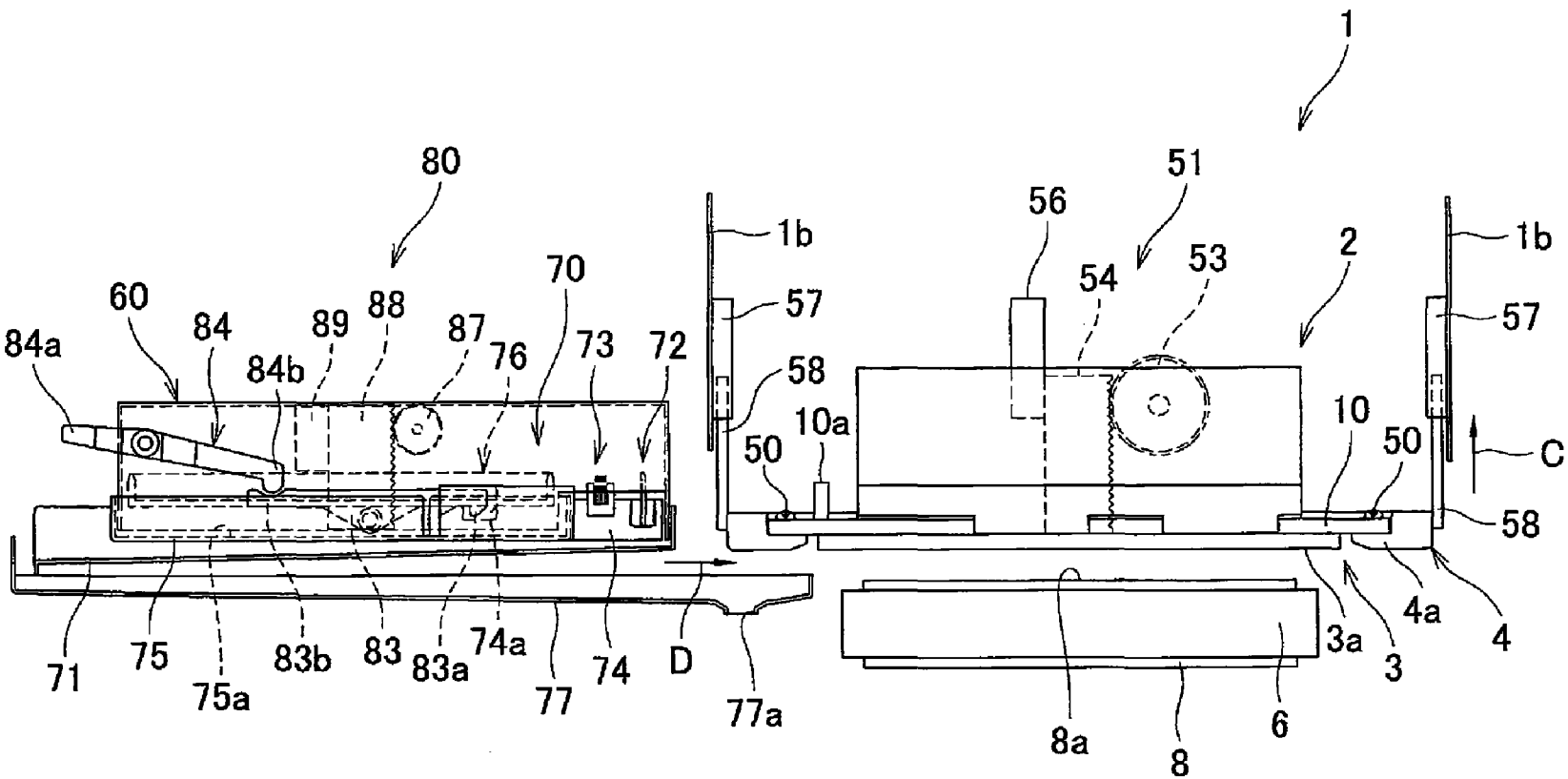
FIG. 3 is a cross-sectional view along line III-III of FIG. 2.

Each of the ink-jet heads 2 may dispense a different color of ink, such as magenta ink, yellow ink, cyan ink, and black ink, respectively, and may be arranged along a paper conveyance direction B. Thus, the ink-jet printer 1 may be a line-type printer. Referring to FIG. 2, each of the ink-jet heads 2 may have a rectangular shape with its longer side extending perpendicularly to the paper conveyance direction B. Referring to FIGS. 1 and 3, each of the ink-jet heads 2 may comprise a head main body 3 at its lower end. The head main body 3 may have a layered structure laminated with a passage unit and an actuator. Ink passages comprising pressure chambers may be formed in the passage unit. The actuator mat apply pressure to ink contained in the pressure chambers. A reservoir unit 10 may be positioned at an upper face of the head main body 3. An ink reservoir which stores ink therein may be formed inside the reservoir unit 10. Ink supplied from a tube joint 10*a* may be stored in the ink reservoir. The reservoir unit 10 may be longer than the head main body 3, such that it protrudes beyond both longitudinal ends of the head main body 3. Protruding portions may fix the reservoir unit 10 to a frame 4. A lower face of the head main body 3 may be an ink ejection surface 3*a* in which a plurality of nozzles are formed. The ink ejection surface 3*a* may oppose the conveyor face 8*a*. An ink ejection port may be formed at a distal end of each nozzle.

Referring to FIG. 9, the tube joint 10*a* may be connected to a pump 134 via a tube to an ink tank (not shown). When forming an image, ink contained in the ink tank may be supplied to the head main body 3 from the ink tank through the tube, the pump 134, and the tube joint 10*a*, and the ink may flow inside the pump 134. When initially introducing ink into the ink-jet head 2 and when performing a purge operation, the pump 134 may be driven to transmit ink to the ink-jet head 2.

The head main body 3 may be positioned, such that the ink ejection surface 3*a* and the conveyor face 8*a* are in parallel with each other with a space being formed therebetween, which may comprise a portion of the paper conveyor path. When a recording medium conveyed on the conveyor belt 8 passes under the four head main bodies 3, ink of respective colors may be ejected from nozzles toward a print face of the recording medium, such that a color image is formed on the paper.

Referring to FIGS. 1 and 2, the ink-jet heads 2 may be fixed to a frame 4. Referring to FIG. 3, the frame 4 may comprise supporters 4*a* which support the reservoir unit 10. The supporters 4*a* may protrude inward and may oppose both longitudinal end portions of the reservoir unit 10. The supporters 4*a* and the both end portions of the reservoir unit 10 may be fixed via screws 50. The ink ejection surface 3*a* may be at substantially the same height as a lower face of the supporter 4*a*, and may be exposed via a through hole of the frame 4.

The frame 4 may be supported by a plurality of, e.g., two, frame movement mechanisms 51 to be configured to move in an up-and-down direction. The frame movement mechanisms 51 may be positioned in the printer 1. Referring to FIG. 2, the frame movement mechanisms 51 may be positioned to oppose sandwich the four ink-jet heads therebetween. Each frame movement mechanism 51 may comprise a drive motor 52, a pinion gear 53, a rack gear 54, and a guide 56. The drive motor 52 may operate to move the frame 4 up and down. The pinion gear 53 may be fixed to a shaft of the drive motor 52. The rack gear 54 may be positioned on the frame 4 to engage the pinion gear 53. The guide 56 maybe positioned to oppose sandwich the rack gear 54 between the guide 56 and the pinion gear 53.

The two drive motors 52 may be fixed, respectively, to a pair of main frames 1*a* of the ink-jet printer 1. The pair of main frames 1*a* may extend along a longitudinal direction of the ink-jet head 2, and may oppose each other across the frame 4 with respect to the paper conveyance direction B. Each of the two rack gears 54 may extend in a vertical direction, and may have its lower end fixed to a side face of the frame 4. A side face of the rack gear 54 opposing the pinion gear 53 slidable contact the guide 56. The guide 56 may be fixed to the main frame 1*a*.

When the two drive motors 52 are driven in synchronization to rotate the pinion gears 53, the rack gears 54 may move in the vertical direction, and the frame 4 and the ink-jet heads 2 may move in the vertical direction.

Guide units may be positioned on both longitudinal ends of the ink-jet heads 2. Each of the guide units may comprise a rod 58, and a pair of guides 57 which may sandwich the rod 58 therebetween. Referring to FIG. 3, the pair of guides 57 may extend in the vertical direction, and may be fixed respectively to a pair of main frames 1*b* of the ink-jet printer 1. The pair of main frames 1*b* may extend along the paper conveyance direction B, and may oppose each other across the frame 4 with respect to the longitudinal direction of the ink-jet head 2. The rod 58 may extend in the vertical direction similar to the guide 57, and may be fixed to a side face of the frame 4 extending along the paper conveyance direction. The rod 58 may be slidable over the guides 57. When the frame movement mechanisms 51 move the frame 4 in the vertical direction, the guide unit may prevent the ink ejection surface 3*a* of the ink-jet head 2 from becoming inclined relative to the conveyor face 8*a*. This may enable ink to be accurately dispensed on a recording medium during a print operation.

Referring to FIG. 3, the frame 4 and the ink-jet heads 2 generally may be positioned in a print position at which the ink-jet heads 2 perform printing by ejecting ink to a recording medium. Nevertheless, when maintenance is performed on the ink-jet heads 2, the frame 4 and the ink-jet heads 2 move upward by the frame movement mechanism 51 into a maintenance position which may be located above the print position. In this embodiment, the performance of maintenance may comprise forcibly ejecting ink from nozzles in recovering the ink-jet heads 2 from ejection failure, i.e., purge operation, receiving ink adhering to the ink ejection surface 3*a*, and covering the ink ejection surface 3*a* with a cap 76.

Figure 4:
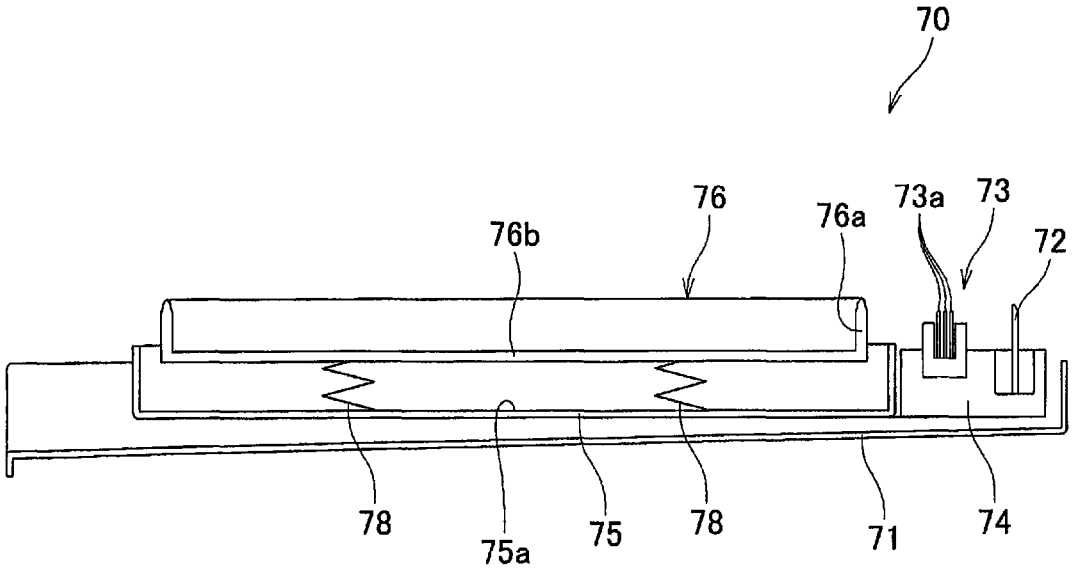
FIG. 4 is a cross-sectional view of a maintenance unit of FIG. 2.

Referring to FIGS. 2-4, the maintenance unit 70 may be positioned on a left side of the ink-jet heads 2 during a printing operation. The maintenance unit 70 may comprise two frames 71 and 75 which are configured to move in a horizontal direction. The frame 71 may have a substantially square, box-like shape with its upper side opened, and the frame 71 may receive therein the frame 75. The frame 71 and the frame 75 may be detachably coupled to each other by an engager, such that they may be selectively attached to and detached from each other depending on the maintenance which is being performed. The frame 71 may be opened at its side most distant from the ink-jet heads 2. Accordingly, when the frame 71 and the frame 75 are disengaged from each other, the frame 71 may move independent of the frame 75. Independent of a state of engagement by the engager, before the maintenance unit 70 moves horizontally, the frame 4 and the ink-jet heads 2 may move in an arrow-C direction in FIG. 3 into the maintenance position. Thus, a space between the four ink ejection surfaces 3*a* and the conveyor face 8*a* may be reserved for the maintenance unit 70. Then, the maintenance unit 70 may move horizontally in an arrow-D direction in FIG. 3.

A waste ink receiver 77 may be disposed under the maintenance unit 70. The frame 71 may be positioned within the waste ink receiver 77, and when the frame 71 moves to a rightmost point in FIGS. 3 and 11A, an end portion of the frame 71 may overlap with the waste ink receiver 77. An end of the waste ink receiver 77 in the arrow-D direction may have an ink discharge hole 77*a* formed therethrough, which may extend through the ink receiver 77 in the vertical direction. Ink transmitted into the waste ink receiver 77 moves through the ink discharge hole 77*a* to a waste ink reservoir (not shown).

A wiper 72, an ink receiving member 73, and the frame 75 may be positioned in this order within the frame 71. The wiper 72 and the ink receiving member 73 may extend along the paper conveyance direction B. Referring to FIG. 2, four caps 76, which may have a rectangular shape, may be positioned side by side within the frame 75. The four caps 76 correspond to the ink ejection surfaces 3*a* of the ink-jet heads 2. A longitudinal side of the cap 76 may be in parallel with the longitudinal direction of the ink-jet head 2. An interval of the caps 76 with respect to the paper conveyance direction B may be the same as that of the ink-jet heads 2. Refers to FIG. 4, the cap 76 has a base 76*b* and an annular protrusion 76*a* that protrudes upward from the base 76*b*. The annular protrusion 76*a*, which may have recess forced therein, may come into contact the ink ejection surface 3*a* to form an enclosed space. Thereby, the cap 76 may cover the ink ejection surface 3*a*, thus preventing ink in nozzles from drying up. The cap 76 may comprise an elastic material such as rubber. This makes it easy for the annular protrusion 76*a* to be in close contact the ink ejection surface 3*a*, to thereby improve an air tightness of a space formed by contact of the annular protrusion 76*a* into the ink ejection surface 3*a*. In addition, it may be less likely that the annular protrusion 76*a* damages the ink ejection surface 3*a*.

Each cap 76 may be supported by a plurality of springs 98, on a bottom face 75*a* of the frame 75. The springs 78 may be sandwiched between the base 76*b* of the cap 76 and the bottom face 75*a* of the frame 75, and biases the cap 76 against the frame 75, that is, biases it upward. Because the cap 76 may be supported by the springs 78, impact caused when the annular protrusion 76*a* contacts the ink ejection surface 3*a* may be reduced by the springs 78. Consequently, it is still less likely that the annular protrusion 76*a* damages the ink ejection surface 3*a*. Further, even when the cap 76 is not completely in parallel with the ink ejection surface 3*a*, the cap 76 may follow inclination of the ink ejection surface 3*a*. As a result, the annular protrusion 76*a* of the cap 76 and the ink ejection surface 3*a* may surely be in close contact, so that the space enclosed by the cap 76 and the ink ejection surface 3*a* obtains an improved air tightness.

Referring to FIG. 2, a holding member 74 which holds the wiper 72 and the ink receiving member 73 may be fixed within the frame 71, at an end portion of the frame 71 closest to the ink-jet heads 2. The holding member 74 may have a U-like shape, and holds the wiper 72 and the ink receiving member 73 by its portions extending along the paper conveyance direction B. A recess 74*a* may be formed at a portion of the holding member 74 extending along the longitudinal direction of the ink-jet head 2. The recess 74*a* may be included in the engager.

Referring to FIGS. 2 and 4, the ink receiving member 73 may comprise a plurality of thin plates 73*a* that are a little longer than a width of a set of the four ink-jet heads 2 arranged side by side. The thin plates 73*a* may be positioned in parallel with each other at intervals based on the capillary force on ink. The thin plate 73*a* may comprise a stainless steel. The wiper 72 may be longer than the width of the set of the four ink-jet heads 2 arranged side by side. The longitudinal side of wiper 72 may extend along the paper conveyance direction B. The wiper 72 may comprise an elastic material, such as rubber.

As described above, the frame 71 and the frame 75 are engaged with each other in a detachable manner by the engager. Referring to FIG. 2, the engager may be positioned adjacent to each of upper and lower sides of the frames 71 and 75. Each engager includes the recess 74*a* formed in the holding member 74, and a hook member 83 rotatably supported on the frame 75. The recess 74*a* may be formed adjacent to an end of the holding member 74 most distant from the ink-jet heads 2. The hook member 83 may extend along the longitudinal direction of the ink-jet head 2. The hook member 83 may be at its center, rotatably supported by two flanges that are positioned on the bottom face 75*a*. A hook 83*a* engaged with the recess 74*a* may be positioned at an end of the hook member 83 closest to the ink-jet heads 2. Above the maintenance unit 70, contact members 84 are rotatably supported. The contact member 84 may be in contact an end 83*b* of the hook member 83 most distant from the ink-jet heads 2.

An end 84*a* of the contact member 84 most distant from the ink-jet heads 2 may be connected to a retractable cylinder 85. When the cylinder 85 retracts when the contact member 84 may be separated from the hook member 83, the contact member 84 rotates clockwise in FIG. 3 so that the end 84*b* of the contact member 84 closest to the ink-jet heads 2 comes into contact the end 83*b* of the hook member 83 and pushes down the end 83*b*. Consequently, the hook member 83 may rotate counterclockwise in FIG. 3, to disengage the hook 83*a* from the recess 74*a*.

Then, when the cylinder 85 extends, the contact member 84 rotates counterclockwise in FIG. 3. The hook member 83 rotates clockwise, to bring the hook 83*a* into engagement with the recess 74*a*, thus returning to a state of FIG. 3.

When maintenance is performed, the maintenance unit 70 may remain in a "retracted position" which is away from the ink-jet heads 2 referring to FIGS. 2 and 3. That is, the maintenance unit 70 stays in a position not opposed to the ink-jet heads 2 with respect to the vertical direction. In performing maintenance, the maintenance unit 70 may horizontally move from the retracted position into a "maintenance position" which may oppose the ink ejection surfaces 3*a* of the ink-jet heads 2 with respect to the vertical direction. During movement, distal ends of the wiper 72 and the annular protrusions 76*a* do not in contact the ink ejection surfaces 3*a*, because the ink-jet heads 2 have already been in the maintenance position. The ink receiving member 73 may be configured to form a narrow space, e.g., substantially 0.5 mm between the ink receiving member 73 and the ink ejection surface 3*a* when the wiper 72 may contact the ink ejection surface 3*a*.

In performing a purge operation, the frame 71 alone moves from the retracted position and the frame 75 left behind. In covering the ink ejection surfaces 3*a* with the caps 76, the frame 71 and the frame 75 may move into the maintenance position when it is engaged with each other. Referring to FIG. 2, the frame 71 and 75 may be supported on a pair of guide shafts 96*a* and 96*b* in a movable manner. The pair of guide shafts 96*a* and 96*b* may extend along the longitudinal direction of the ink-jet head 2. A plurality of bearings 97*a* and 97*b* may be positioned on the frame 71. The bearings 97*a* and 97*b* may protrude respectively from upper and lower side faces of the holding member 74 in FIG. 2. A plurality of bearings 98*a* and 98*b* may be positioned on the frame 75. The bearings 98*a* and 98*b* may protrude respectively from upper and lower side faces of the frame 75 in FIG. 2. The guide shafts 96*a* and 96*b* may oppose upper and lower side edges of the frame 71 in FIG. 2. The bearings 97*a* and 98*a* may be supported on the guide shaft 96*a*, and the bearings 97*b* and 98*b* may be supported on the guide shaft 96*b*. Both ends of the pair of guide shafts 96*a* and 96*b* may be fixed with screws to the main frame 1*b* at a right side in FIG. 2 and to a main frame 1*d*. The pair of guide shafts 96*a* and 96*b* are disposed in parallel with each other. The frames 71 and 75 may move along the guide shafts 96*a* and 96*b* in a horizontal direction in FIG. 2.

Referring to FIG. 2, the horizontal movement mechanism 91 may comprise a motor 92, a motor pulley 93, an idler pulley 94 paired with the motor pulley 93, a timing belt 95, and the guide shafts 96*a* and 96*b*. An attachment portion 1*c* may be positioned at an end of the right-side main frame 1*b*. The attachment portion 1*c* extends along the longitudinal direction of the ink-jet head 2. The motor 92 may be fixed to the attachment portion 1*c* with a screw or the like. The motor pulley 93 may be connected to the motor 92, and rotates as the motor 92 is driven. The idler pulley 94 may be rotatably supported on the main frame 1*d* which locates leftmost in FIG. 2. The timing belt 95 may be positioned in parallel with the guide shaft 96*a*, and be wound on the motor pulley 93 and the idler pulley 94 to be stretched between them. The bearing 97*a* may be connected to the timing belt 95.

Driving the motor 92 causes the motor pulley 93 to rotate and thus the timing belt 95 be driven, and the frame 71 which may be connected to the timing belt 95 via the bearing 97*a* may move leftward or rightward in FIG. 2 toward the retracted position or the maintenance position. When the recess 74*a* of the holding member 74 and the hook 83*a* are engaged, the wiper 72 and the ink receiving member 73, which may be positioned within the frame 71, and the caps 76, which may be positioned within the frame 75, move together into the maintenance position or the retracted position. When the recess 74*a* and the hook 83*a* are not engaged, the frame 75 is left and only the wiper 72 and the ink receiving member 73 may move into the maintenance position or the retracted position.

Figure 6:
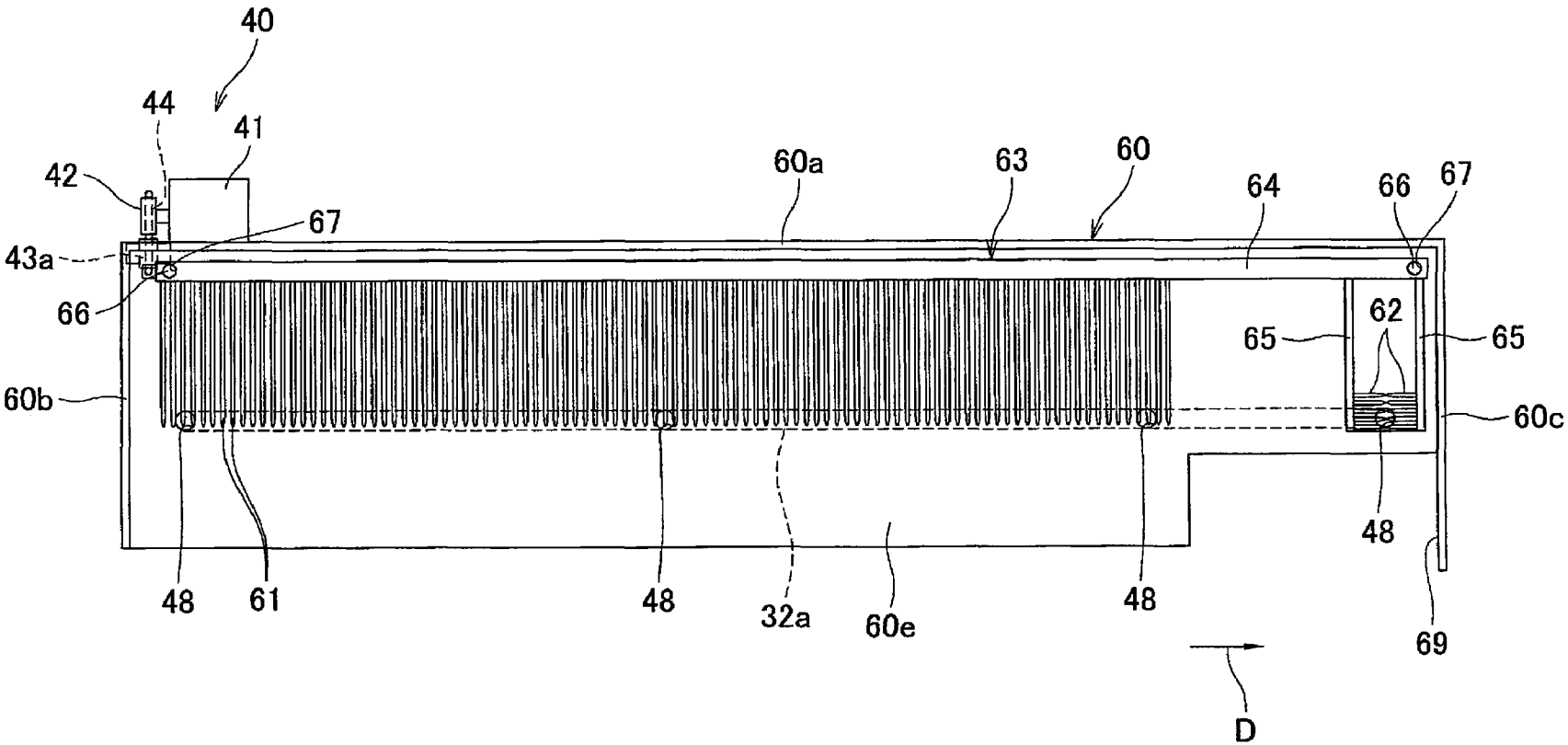
FIG. 6 is a cross-sectional view along line VI-VI in FIG. 5.

The covering 60 may comprise a roof 60*a* which may have a rectangular shape, and side walls 60*b*, 60*c*, 60*d* and 60*e* which extend downward from the roof 60*a*. The covering 60 may have substantially box-like shape which opens toward the maintenance unit 70. Referring to FIG. 6, a longitudinal side of the covering 60 is the arrow-D direction. Recesses 69 may formed in portions of the side walls 60*d* and 60*e* opposed to the holding members 74. Thereby, when the covering 60 covers the maintenance unit 70, the holding members 74 and the side walls 60*d* and 60*e* may be not be in contact each other.

Figure 5:
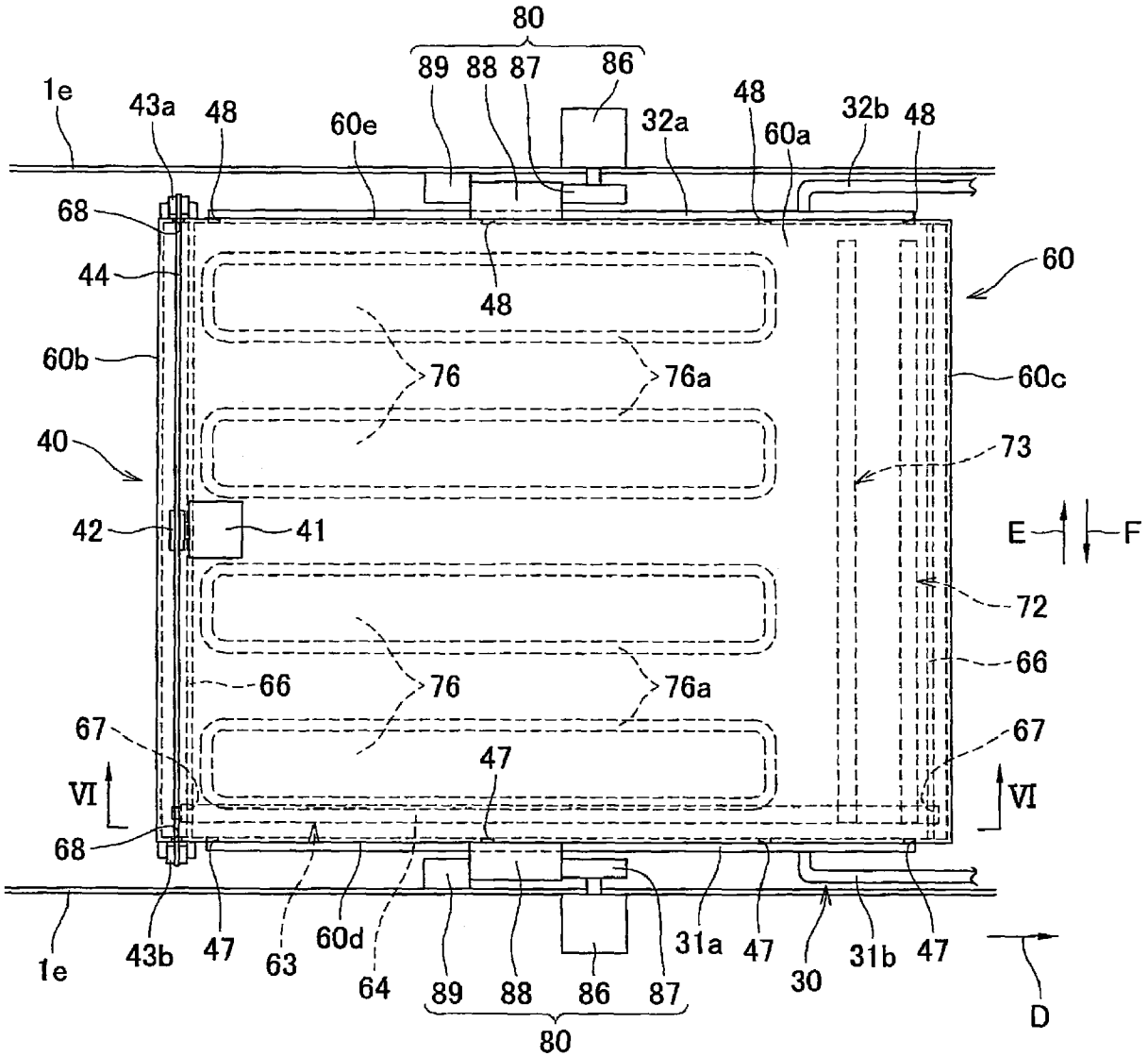
FIG. 5 is an enlarged plan view of a covering of FIG. 2.

Referring to FIG. 6, a brush 63 may be positioned within the covering 60. Referring to FIG. 5, the brush 63 may comprise a base 64 which is elongated along the arrow-D direction and extends between the side walls 60*b* and 60*c*. The brush 63 may be divided into three regions, e.g., a region opposed to the wiper 72, a region opposed to the ink receiving member 73, and a region opposed to the four caps 76. A plurality of flexible needle members 61 may be positioned on a lower face of the base 64 in a region opposed to the caps 76. The flexible needle members 61 may extend downward. The flexible needle members 61 are arranged along the arrow-D direction, and when the covering 60 is covering the maintenance unit 70, the flexible needle members 61 may contact the annular protrusion 76*a* of the cap 76. As the brush 63 moves in an arrow-E direction in FIG. 5, the flexible needle members may be opposed to the cap 76.

Referring to FIG. 6, there may be a plurality of protrusions 65 in a region of the base 64 which oppose the wiper 72. The protrusions 65 may extend downward from the lower face of the base 64. At a distal end portion of each protrusion 65, a plurality of flexible needle members 62 may extend toward the other protrusion 65. The flexible needle members 62 may be positioned, such that their distal ends substantially contact each other. Referring to FIG. 3, when the covering 60 covers the maintenance unit 70 the flexible needle members 62 may sandwich the wiper 72 therebetween. When the covering 60 covers the maintenance unit 70, a space corresponding to this region accommodates the ink receiving member 73.

Referring to FIG. 5, the brush movement mechanism 40 may be mounted on the covering 60, and may move the brush 63 horizontally in the arrow-E direction. The brush movement mechanism 40 may comprise a motor 41, a motor pulley 42, a plurality of idler pulleys 43*a* and 43*b*, a timing belt 44, and a plurality of guides 66 which support the brush 63. The motor 41 may be positioned at an upper face of the roof 60*a*. The motor 41 may be positioned at a center with respect to the arrow-E direction. The motor pulley 42 may be connected to the motor 41. The idler pulleys 43*a* and 43*b* may be rotatably positioned to oppose upper ends of the side walls 60*d* and 60*e*. The timing belt 44 may be exposed between the idler pulleys 43*a* and 43*b*, and may be wound on the motor pulley 42. The timing belt 44 passes through holes 68 which may be positioned in upper end portions of the respective side walls 60*d* and 60*e*. The pair of guides 66 may be positioned at left and right ends of the base 64. Each guide 66 may extend along the arrow-E direction between the side walls 60*d* and 60*e*. The base 64 may have through holes 67, through which the guides 66 may be inserted. The base 64 may be supported by the plurality of guides 66 in a slidable manner. An end of the base 64 may be connected to the timing belt 44.

Driving the motor 41 may cause the motor pulley 42 to rotate and the timing belt 44 to travel. Along with the traveling of the timing belt 44, the brush 63 connected to the timing belt 44 may move in the arrow-E direction or an arrow-F direction which is opposite the arrow-E direction.

When the brush 63 is in a position closest to the side wall 60*d*, an end of the base 64 facing the side wall 60*e* may oppose one of the annular protrusions 76*a* closest to the side wall 60*d*. When the brush 63 is in a position closest to the side wall 60*e*, an end of the base 64 facing the side wall 60*d* may oppose one of the annular protrusions 76*a* closest to the side wall 60*e*. When the covering 60 is in a retracted position, the brush 63 may be in the position closest to the side wall 60*d*. When the covering 60 is in a covering position, the flexible needle members 61 may contact one of the annular protrusions 76*a* closest to the side wall 60*d*, and the flexible needle members 62 may contact the wiper 72.

Referring to FIGS. 2 and 5, the covering movement mechanism 80 may be positioned on each of a plurality of main frames 1*e*. The main frames 1*e* may extend along the longitudinal direction of the ink-jet head 2, and may be positioned to oppose each other with respect to the paper conveyance direction B. The covering 60 may be supported by a plurality of covering movement mechanisms 80, and may be configured to move in the vertical direction. The covering movement mechanisms 80 may comprise a drive motor 86, a pinion gear 87, a rack gear 88, and a guide 89. The drive motor 86 may be positioned to oppose the main frame 1*e*. The pinion gear 87 may be fixed to a shaft of the drive motor 86. The rack gear 54 may be positioned to oppose the side wall 60*d* or 60*e* of the covering 60 to engage the pinion gear 53. The guide 89 may be positioned, such that the rack gear 88 is sandwiched between the guide 89 and the pinion gear 87. The guide 89 may be positioned to oppose the main frame 1*e*. The two rack gears 88 may extend in the vertical direction. A side face of the rack gear 88 facing opposite the pinion gear 87 may slide to the guide 89. When the two drive motors 86 are driven in synchronization to rotate the pinion gears 87, the rack gears 88 may be moved in the vertical direction. When the rack gears 88 move up and down, the covering 60 may be moved in the vertical direction.

Referring to FIGS. 3 and 13, when the maintenance unit 70 is in the retracted position, the covering 60 may be in a "covering position" at which the covering 60 covers the maintenance unit 70 from above. In performing maintenance, the covering movement mechanism 80 may move the covering 60 upward from the position thereof into a "retracted position".

Figure 7:
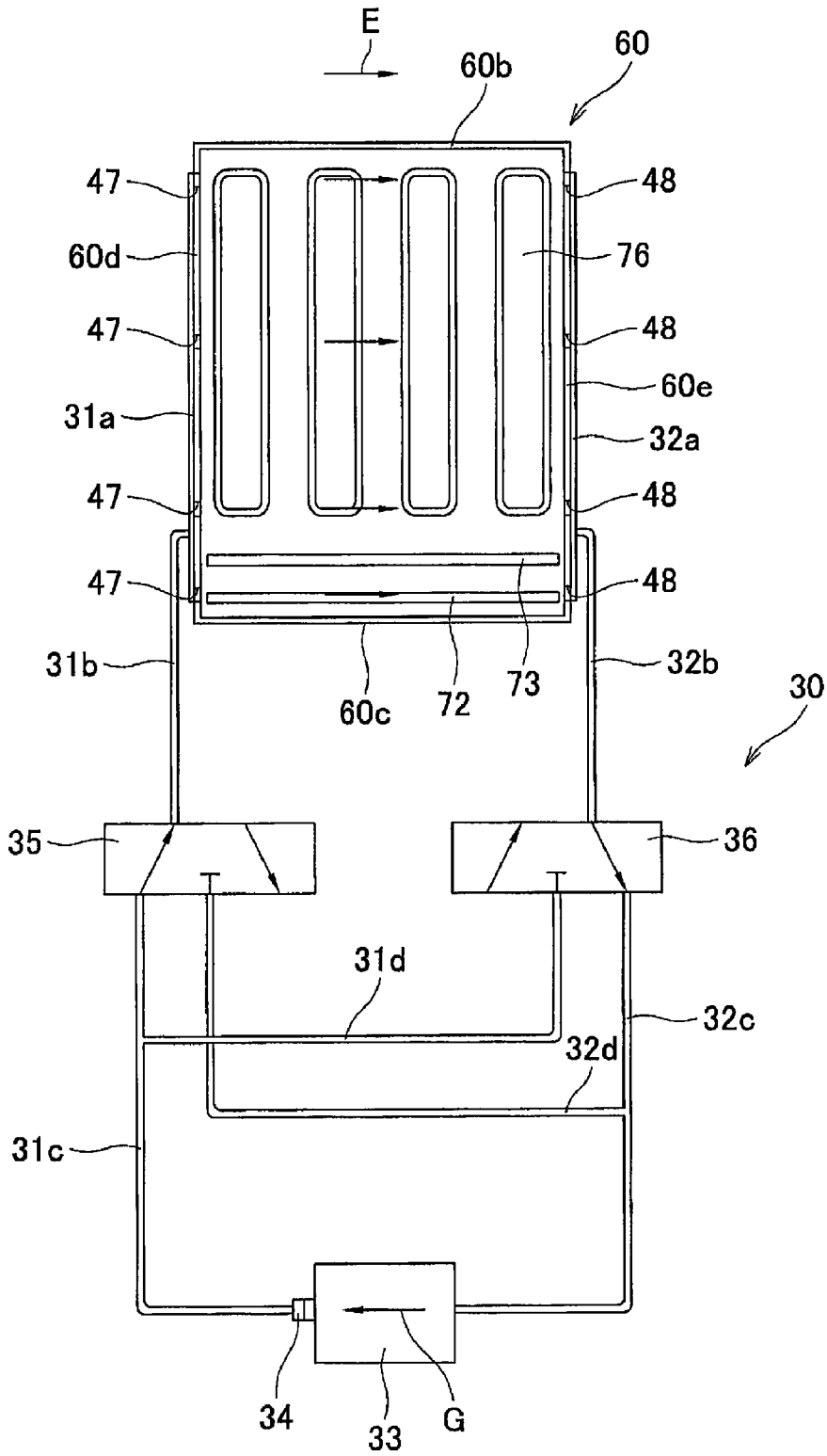
FIG. 7 shows a state of switching valves in producing an airflow directed in an arrow-E direction inside the covering of FIG. 5.
Figure 8:
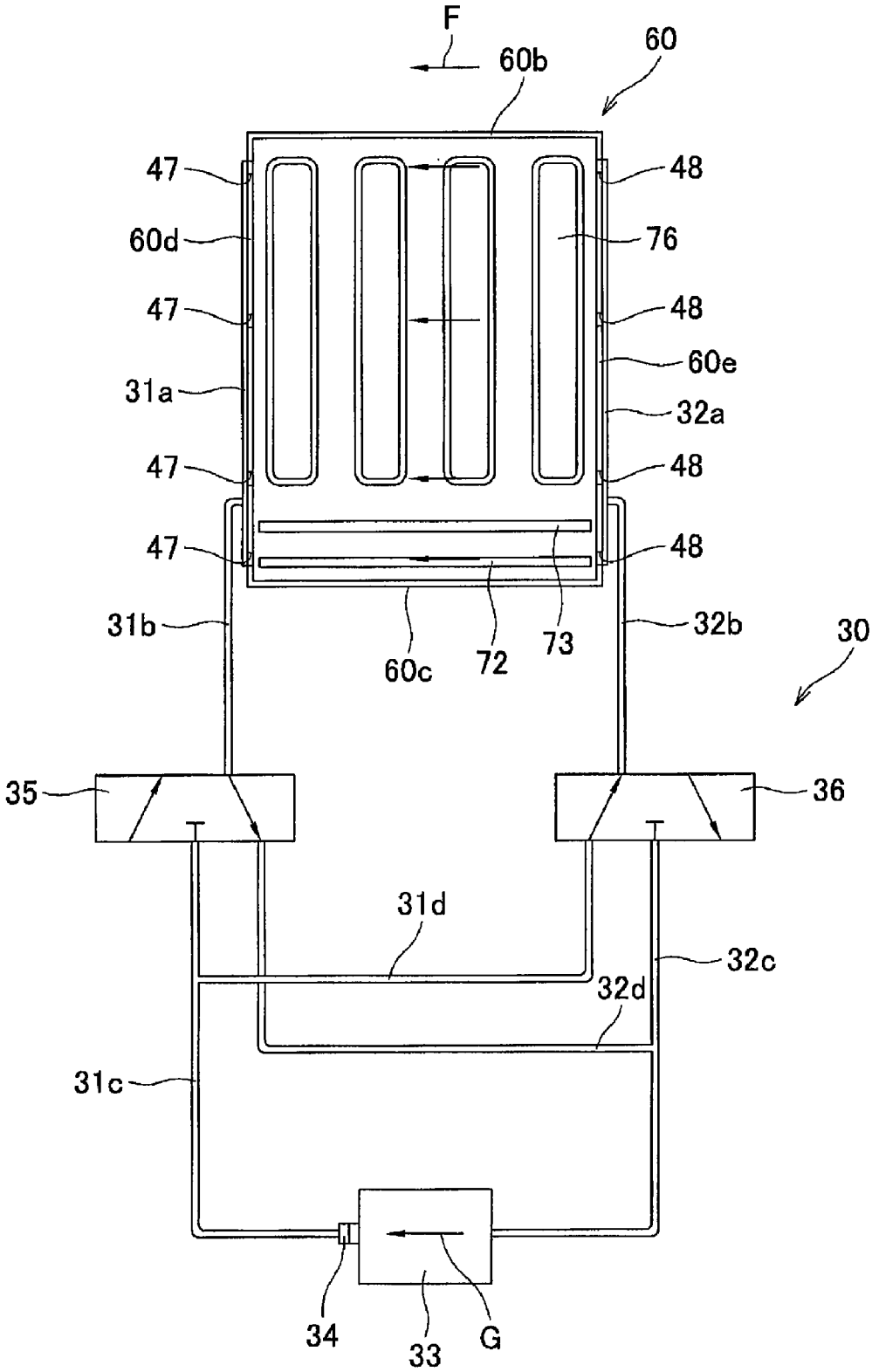
FIG. 8 shows a state of the switching valves in producing an airflow directed in an arrow-F direction inside the covering of FIG. 5.

Referring to FIGS. 7 and 8, the printer 1 may comprise an airflow generation mechanism 30 which generates an airflow in the covering 60. The airflow generation mechanism 30 may comprise a blower 33, a filter 34, a plurality of switching valves 35 and 36, and pipes 31*a*, 31*b*, 31*c*, 31*d*, 32*a*, 32*b*, 32*c*, and 32*d*. The filter 34 may be connected to an air outlet port of the blower 33. The switching valves 35 and 36 may switch an airflow passage. The pipes 31*a*, 31*b*, 31*c*, 31*d*, 32*a*, 32*b*, 32*c*, and 32*d* may connect the blower 33 to the air outflow ports. The pipes 31*a* and 32*a* may be positioned to oppose the side walls 60*d* and 60*e*. The pipes 31*a* and 32*a* may have four outflow ports. Referring to FIGS. 5-8, through holes 47 and 48 may be formed in the sidewalls 60*d* and 60*e*. The through holes 47 or 48 may correspond to the four outflow ports. The through holes 47 and 48 may be formed at the region of the brush 63 which opposes the wiper 72. The other three pairs of the through holes 47 and 48 may be positioned at substantially regular intervals with respect to the arrow-D direction. One of the through holes 47 and 48 may be an air inflow port, and the other may be an air outflow port.

The through holes 47 and the four through holes 48 may oppose each other with respect to an arrow-E direction, and may be connected to the pipes 31*a* and 32*a*. The pipes 31*a* and 32*a* may be connected to one ends of the pipes 31*b* and 32*b*. The other ends of the pipes 31*b* and 32*b* may be connected to the switching valves 35 and 36. The switching valves 35 and 36 may be connected to one ends of the pipes 31*c* and 32*c*. The other ends of the pipes 31*c* and 32*c* may be connected to the blower 33. One airflow passage may extend from the flower 33, through the pipe 31*c*, the switching valve 35, the pipe 31*b*, and the pipe 31*a*, to the through holes 47. The other airflow passage may extend from the flower 33, through the pipe 32*c*, the switching valve 36, the pipe 32*b*, and the pipe 32*a*, to the through holes 48. The switching valve 35 may be connected to the pipe 32*c* via the bypass pipe 32*d*. The switching valve 36 may be connected to the pipe 31*c* via the bypass pipe 31*d*. By switching an airflow passage by the switching valves 35*a* and 36, which of the through holes 47 and the through holes 48 function as air inflow port or air outflow ports is changed.

The switching valve 35 may be switched to connect the air outlet port of the blower 33 to the through holes 47 in order to generate an airflow inside the covering 60 in the arrow-E direction. The switching valve 36 may be switched to connect an air inlet port of the blower 33 to the through holes 48. A circulation of air flowing in one direction between the blower 33 and the covering 60 may occur. At this time, the switching valve 35 may disconnect the pipe 32*d* from the airflow passage, and the switching valve 36 may disconnect the pipe 31*d* from the airflow passage. When the blower 33 is driven, air supplied from the blower 33 through the filter 34 may pass through the pipe 31*c*, the switching valve 35, the pipe 31*b*, and the pipe 31*a*, and then may be supplied through the through holes 47 into the covering 60. The air inlet port of the blower 33 may communicate with the through holes 48 through the pipe 32*c*, the switching valve 36, the pipe 32*b*, and the pipe 32*a*. Air enclosed by the covering 60 may be drawn through the through holes 48. An airflow in the arrow-E direction, which is from the through holes 47 toward the through holes 48, may be generated inside the covering 60.

For generating an airflow inside the covering 60 in the arrow-F direction, the switching valve 35 may be switched to disconnect the pipe 31*b* from the pipe 31*c* and to connect the pipe 31*b* to the pipe 32*d*. The switching valve 36 may be switched to disconnect the pipe 32*b* from the pipe 32*c* and to connect the pipe 32*b* to the pipe 31*d*. A circulation of air flowing in the other direction between the blower 33 and the covering 60 may occur. When the blower 33 is driven, air supplied from the blower 33 through the filter 34 may pass through the pipe 31*c*, the pipe 31*d*, the switching valve 36, the pipe 32*b*, and the pipe 32*a*, and then may be supplied through the through holes 48 into the covering 60. The air inlet port of the blower 33 may communicate with the through holes 47 through the pipe 32*c*, the pipe 32*d*, the switching valve 35, the pipe 31*b*, and the pipe 31*a*. Air enclosed by the covering 60 may be drawn through the through holes 47. An airflow in the arrow-F direction, may be formed inside the covering 60.

Referring to FIG. 9, the ink-jet printer 1 may comprise a controller 101 which controls operations of respective parts of the printer 1. The controller 101 may comprise a CPU (Central Processing Unit) which is an arithmetic processor, a ROM (Read Only Memory) which stores therein a control program executed by the CPU and data used for the control program, and a RAM (Random Access Memory) which temporarily stores therein data during execution of a program. From these parts, a head controller 111, a conveyance controller 112, a purge controller 113, and a covering controller 114 may be deemed.

When the controller 101 receives print data from a PC (Personal Computer) 100, the head controller 111 may control a head drive circuit 121 to eject ink from a ink-jet head 2.

When the controller 101 receives print data from the PC 100, the conveyance controller 112 may control a motor driver 122 to drive the motor 132 to rotate the pick-up roller 22 to convey a paper onto the conveyor belt 8. At this time, the conveyance controller 112 may also control a motor driver 123 to drive the conveyor motor 133 to convey the paper on the conveyor belt 8.

The purge controller 113 may comprise a pump controller 116, a head movement controller 117, and a maintenance unit movement controller 118. When the controller 101 receives a purge signal from the PC 100 and when ink is initially introduced into the ink-jet heads 2, the pump controller 116 may control a pump driver 124 to drive the pump 134 to forcibly send ink to the ink-jet heads 2. When the controller 101 receives a purge signal from the PC 100, ink is initially introduced into the ink-jet heads 2, and when the ink-jet printer is in a sleep mode the head movement controller 117 may control a motor driver 125 to drive the drive motor 52 to move the ink-jet heads 2 from the print position to the maintenance position. When maintenance on the ink-jet heads 2 is completed, the head movement controller 117 may control the motor driver 125 to drive the drive motor 52 to move the ink-jet heads 2 from the maintenance position to the print position.

When the controller 101 receives a purge signal from the PC 100 and when ink is initially introduced into the ink-jet heads 2, the maintenance unit movement controller 118 may control a cylinder driver 126 to retract the cylinder 85 to disengage the hook 83*a* from the recess 74*a*, and may control a motor driver 127 drive the motor 92 to move the frame 71 to the maintenance position. When a purge operation or an initial introduction of ink is completed, the maintenance unit movement controller 118 may control the motor driver 127 to drive the motor 92 to move the frame 71 to the retracted position, and controls the cylinder driver 126 to expend the cylinder 85 to engage the hook 83*a* with the recess 74*a*. When the ink-jet printer is in the sleep mode, the maintenance unit movement controller 118 may control the motor driver 127 to drive the motor 92 to move the frame 71 and the frame 75 to the maintenance position. When the controller 101 receives print data from the PC 100, the maintenance unit movement controller 118 may control the motor driver 127 to drive the motor 92 to move the frame 71 and the frame 75 to the retracted position.

The covering controller 114 may comprise a covering movement controller 115, an airflow controller 119, and a brush movement controller 120. When the maintenance unit 70 stays in the retracted position, the covering movement controller 115 may control a motor driver 128 to drive the drive motor 86 to move the covering 60 to the covering position. When maintenance is performed on the ink-jet heads 2, the covering movement controller 115 may control the motor driver 128 to drive the drive motor 86 to move the covering 60 to the retracted position.

After the covering 60 moves from the retracted position to the covering position and immediately before the covering 60 moves from the covering position to the retracted position, the brush movement controller 120 may control a motor driver 130 to drive the motor 41 to move the brush 63 in the arrow-E direction or in the arrow-F direction. Referring to FIGS. 7, 8, when the brush 63 moves in the arrow-E direction, the airflow controller 119 may control switching valve drivers 135 and 136 to bring the switching valves 35 and 36 into the state, and may control a blower driver 129 to drive the blower 33 such that air filtered through the filter 34 is supplied through the through holes 47 into the covering 60 and air enclosed by the covering 60 is drawn through the through holes 48. When the brush 63 moves in the arrow-F direction, the airflow controller 119 may control the switching valve drivers 135 and 136 to bring the switching valves 35 and 36 into the state and may control the blower driver 129 to drive the blower 33, such that air filtered through the filter 34 is supplied through the through holes 48 into the covering 60 and time air enclosed by the covering 60 is drawn through the through holes 47.

Figure 10:
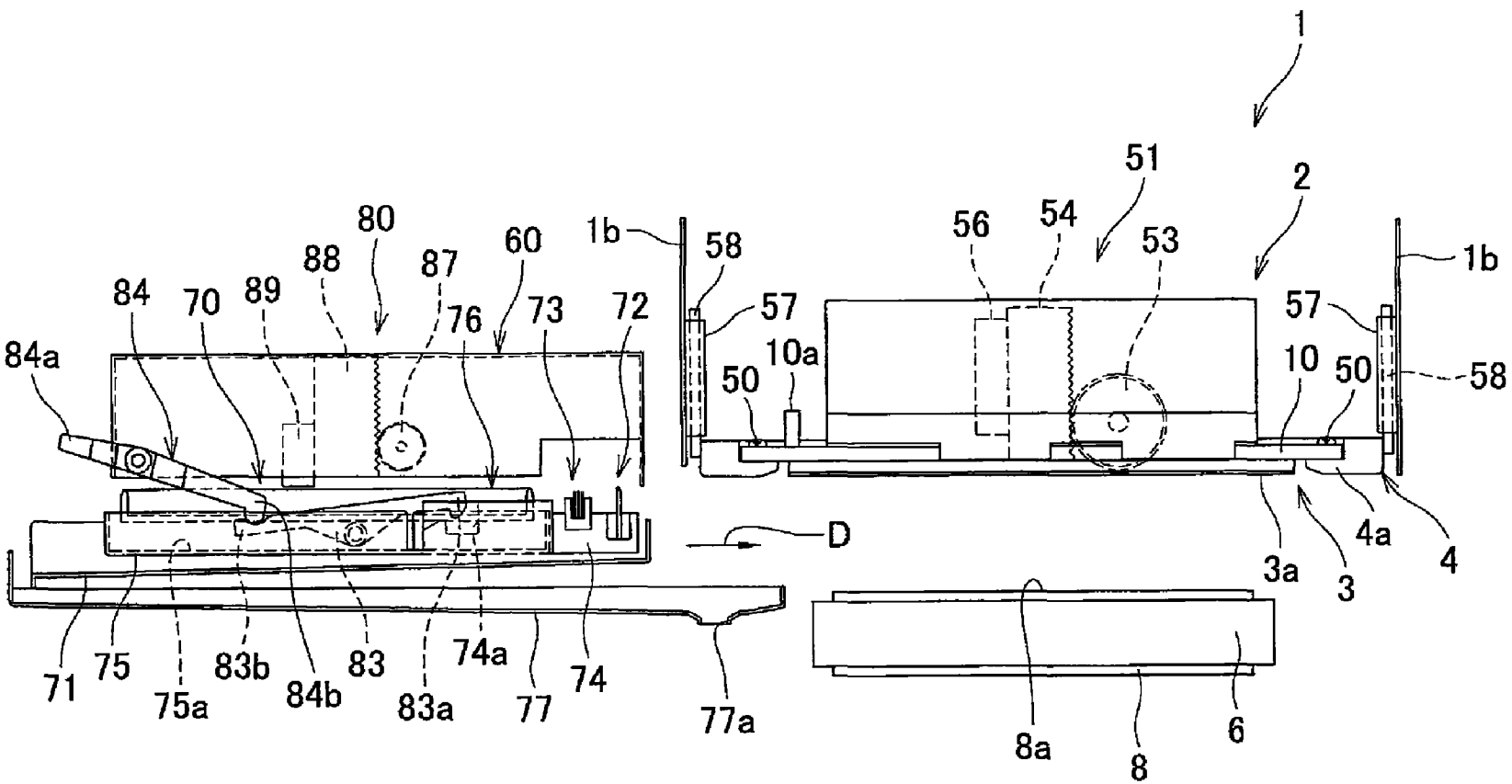
FIG. 10 shows a state where an ink-jet head is in a maintenance position while the covering is in a retracted position.

Referring to FIG. 10, in performing an initial introduction of ink into the ink-jet heads 2 or in performing a purge operation, the head movement controller 117 may drive the two drive motors 52 in synchronization through the motor driver 125, to move the ink-jet heads 2 upward. When the ink-jet heads 2 reach the maintenance position, the head movement controller 117 stops the drive motors 52 through the motor driver 125. A space in which the maintenance unit 71 may be placed between the ink ejection faces 3*a* and the conveyor belt 8. When the ink-jet heads 2 are in the maintenance position, the ink ejection faces 3*a* of the ink-jet heads 2 and the lower face of the frame 4 may not contact maintenance members such as the wiper 72 and the annular protrusions 76*a* during movement of the maintenance unit 70 toward the maintenance position.

Figure 11A:
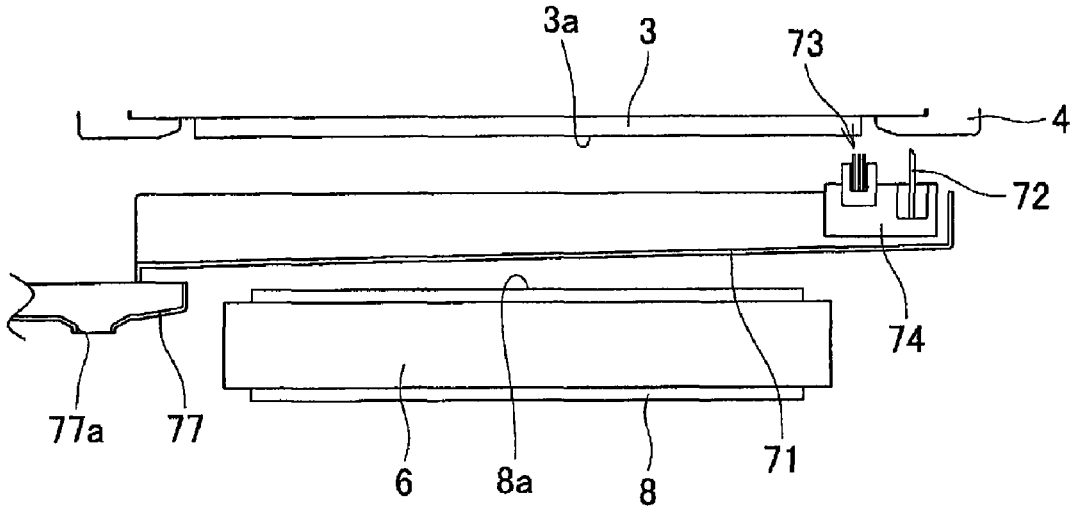
FIG. 11A shows a state where a frame of the maintenance unit is in a maintenance position.

The maintenance unit movement controller 118 may retract the cylinder 85 through the cylinder driver 126. This may make the contact member 84 rotate such that it contacts with the end 83*b* of the hook member 83 and pushes down the end 83*b*. The hook member 83 may rotate counterclockwise, to separate the hook 83*a* from the recess 74*a* and disengage the hook 83*a* from the recess 74*a*. Coupling between the frame 71 and the frame 75 may be released. Then, the maintenance unit movement controller 118 may drive the motor 92 through the motor driver 127, to move the frame 71 in the arrow-D direction. Referring to FIG. 11A, when the frame 71 reaches the maintenance position, the maintenance unit movement controller 118 may stop the motor 92 through the motor driver 127. A left end of the frame 71 may overlaps a right end of the waste ink receiver 77 with respect to the vertical direction.

The pump controller 116 may drive the pump 134 through the pump driver 124, thereby forcibly supplying ink to the ink-jet heads 2 such that ink is ejected from nozzles of the ink-jet heads 2 to inside of the frame 71 (purge operation). Clogging may be eliminated from nozzles may be suffering ejection failure and thickening of ink contained in nozzles may be removed, such that ejection may be stabilized. Thus a purge operation also may be performed when ink is initially introduced into the ink-jet heads 2. Referring to FIG. 11A, because the bottom face of the frame 71 is inclined downward toward a left side ink ejected to the inside of the frame 71 may move along the bottom face of the frame 71 to the left side and then may flow into the waste ink receiver 77. The ink may be discharged through the ink discharge hole 77*a* of the waste ink receiver 77.

Then, the head movement controller 117 may drive the drive motors 52 via the motor driver 125, to move the ink-jet heads 2 downward. When the ink-jet heads 2 come down to such a position that a space of an substantially 0.5 mm is left between the ink ejection faces 3*a* and a distal end of the ink receiving member 73, the head movement controller 117 may stop the two drive motors 52 through the motor driver 125.

Figure 11B:
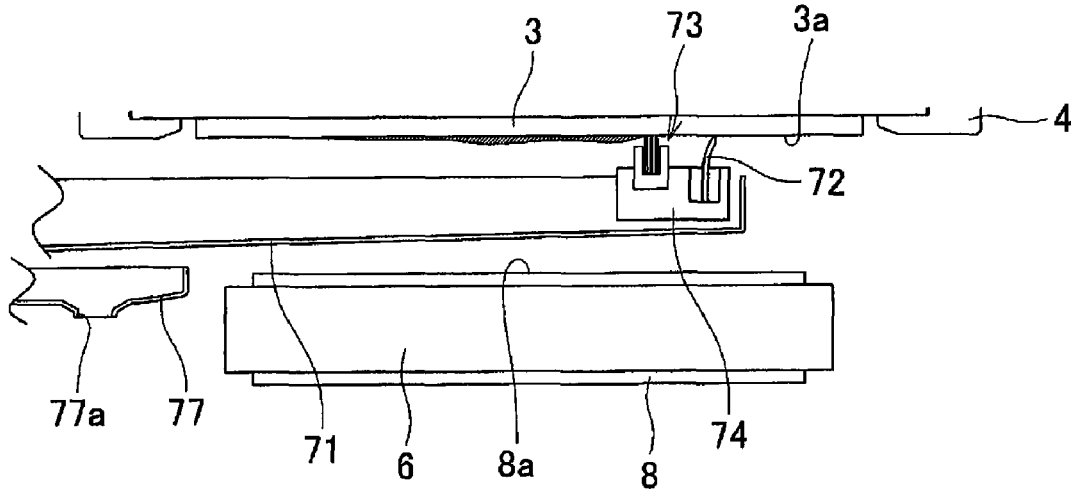
FIG. 11B shows a state where ink adhering to an ink ejection surface is being received by an ink receiving member and being wiped off by a wiper.

Referring to FIG. 11B, the maintenance unit movement controller 118 may drive the motor 92 through the motor driver 127, to move the frame 71 from the maintenance position to the retracted position. The ink receiving member 71 may be spaced apart from the ink ejection faces 3*a* at a predetermined interval, and the ink receiving member 71 may absorb ink adhering to the ink ejection faces 3*a* by capillary force. Because a distal end of the wiper 72 locates above a distal end of the thin plate 73*a*, the wiper 72 may contact the ink ejection faces 3*a* and may be bent in a direction opposite to a movement direction of the frame 71. The wiper 72 may wipe off ink that has not been removed by the ink receiving member 71 and may still remain on the ink ejection faces 3*a*.

When maintenance is completed, the head movement controller 117 may drive the drive motors 52 via the motor driver 125, to move the ink-jet heads 2 downward. When the ink-jet heads 2 reach the print position, the head movement controller 117 may stop the drive motors 52 through the motor driver 125. When the frame 71 reaches the retracted position, the maintenance unit movement controller 118 may extend the cylinder 85 through the cylinder driver 126. The hook 83*a* and the recess 74*a* may be brought into engagement with each other, and the frame 71 and the frame 75 may be coupled to each other.

Figure 12A:
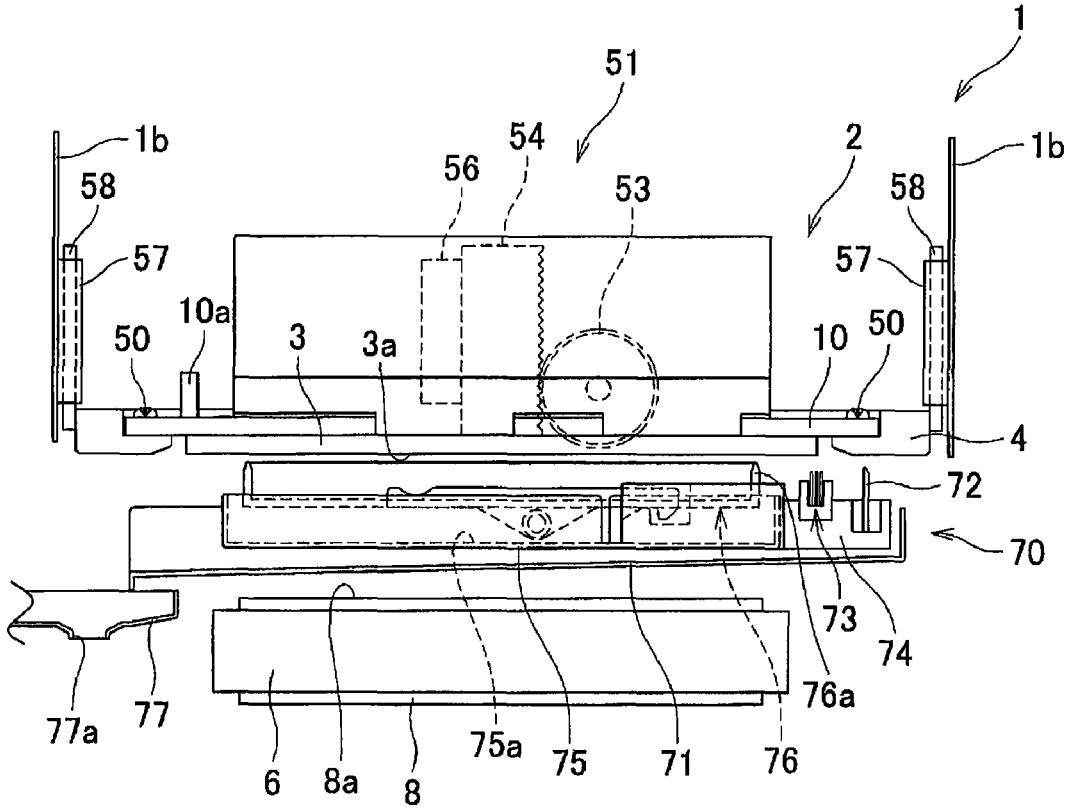
FIG. 12A shows a state where the maintenance unit is in a maintenance position.

When the ink-jet printer is in a sleep mode, the head movement controller 117 may move the ink-jet heads 2 to the maintenance position in the same manner as described above. The maintenance unit movement controller 118 may drive the motor 92 through the motor driver 127, to move the frame 71 and the frame 75 in the arrow-D direction. Referring to FIG. 12A, when the frames 71 and 75 reach the maintenance position, the maintenance unit movement controller 118 may stop the motor 92 via the motor driver 127.

Figure 12B:
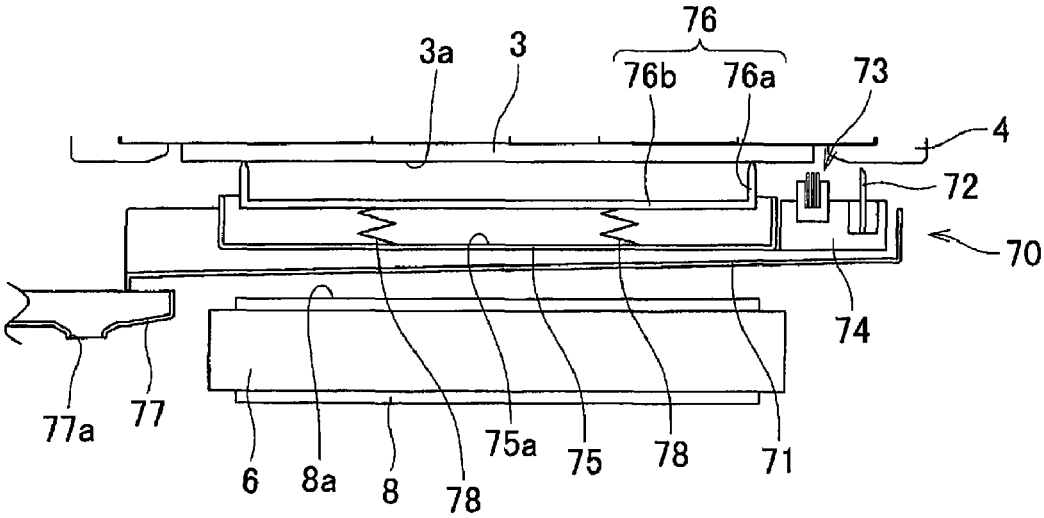
FIG. 12B shows a state where a cap covers the ink ejection surface.

Referring to FIG. 12B, the head movement controller 117 may drive the drive motors 52 via the motor driver 125, to move the ink-jet heads 2 downward. When the ink ejection faces 3*a* of the ink-jet heads 2 contact distal ends of the annular protrusions 76*a* of the caps 76, the head movement controller 117 may stop the drive motors 52 via the motor driver 125. An enclosed space is formed between the ink ejection face 3*a* and the cap 76, to thereby prevent ink contained in nozzles from drying up. Thereafter, when the controller 101 receives print data from the PC 100, the maintenance unit 70 may be returned to the retracted position through a procedure reverse to the above-described one.

Figure 13A:
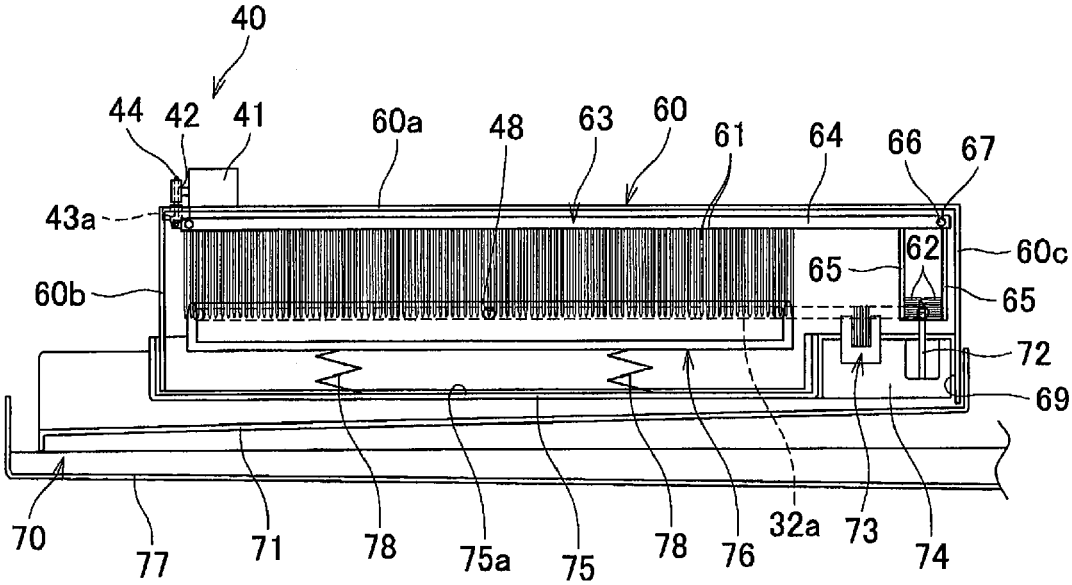
FIG. 13A shows a state where the covering is in a covering position.

Referring to FIG. 13A, when the maintenance unit 70 remains in the retracted position, the covering 60 may be in the covering position at which the covering 60 covers the maintenance unit 70 from above. Before and after maintenance is performed by the maintenance unit 70, the brush 63 may brush the annular protrusions 76*a* and the wiper 72. For example, before the maintenance unit 70 moves from the retracted position to the maintenance position, the brush movement controller 120 may drive the motor 41 through the motor driver 130 to rotate the motor pulley 42 in a normal direction. Referring to FIG. 5, the brush 63 may move from a vicinity of the side wall 60*d* toward the side wall 60*e* in the arrow-E direction. At this time, the flexible needle members 61 may contact distal end portions of the annular protrusions 76*a* of the cap 76, and the flexible needle members 62 may contact a distal end portion of the wiper 72, thereby brushing the distal end portions of the annular protrusions 76*a* and the wiper 72. When the brush 63 reaches a vicinity of the side wall 60*e*, the brush movement controller 120 may drive the motor 41 through the motor driver 130 to rotate the motor pulley 42 in a reverse direction. The brush 63 may return to the vicinity of the side wall 60*d* in the arrow-F direction. When the brush 63 returns to the vicinity of the side wall 60*d*, the brush movement controller 120 may stop driving of the motor 41 via the motor driver 130. During movement of the brush 63 in the arrow-F direction, the flexible needle members 61 and 62 may brush the distal end portions of the annular protrusions 76*a* and the wiper 72.

Because the brush 63 moves reciprocatingly in the arrow-E and arrow-F directions, portions of the annular protrusions 76*a* extending along the arrow-D direction may be in their inner and outer faces at distal ends, bushed by the brush 63. Moreover, portions of the annular protrusions 76*a* extending along the arrow-E direction and the wiper 72 may be at their distal end portions, repeatedly bushed by the brush 63.

The above-described brushing operation by the brush 63 may be where there is an airflow around the brush 63. In association with movement of the brush 63, the blower 33 may be driven and the switching valves 35 and 36 switch an airflow passage. When the brush 63 moves in the arrow-E direction, the airflow controller 119 may bring the switching valves 35 and 36 into the state shown in FIG. 7 via the switching valve drivers 135 and 136. The airflow controller 119 may drive the blower 33 via the blower driver 129, to supply air from the through holes 47 into the covering 60 and draw air enclosed by the covering 60 from the through holes 48. An airflow directed in the arrow-E direction, may be generated within the covering 60. When the brush 63 moves in the arrow-F direction, the airflow controller 119 may bring the switching valves 35 and 36 into the state shown in FIG. 8 via the switching valve drivers 135 and 136. The airflow controller 119 may drive the blower 33 through the blower driver 129, to supply air from the through holes 48 into the covering 60 and draw air enclosed by the covering 60 from the through holes 47. An airflow directed in the arrow-F direction, may be generated within the covering 60. When operation of the brush 63 is completed, the airflow controller 119 may stop driving of the blower 33 through the blower driver 129.

Positions of the air inlet port and the air outlet port of the blower 33 may be the same, and the filter 34 may be positioned at the air outlet port. Therefore, a foreign material discharged from the through holes 47 or 48 may be caught by the filter 34. The blower 33 may filter air drawn out of the covering 60 using the filter 34, and may supply the air into the covering 60. An amount of air supplied into the covering 60 may be substantially equal to an amount of air drawn out of the covering 60.

Figure 13B:
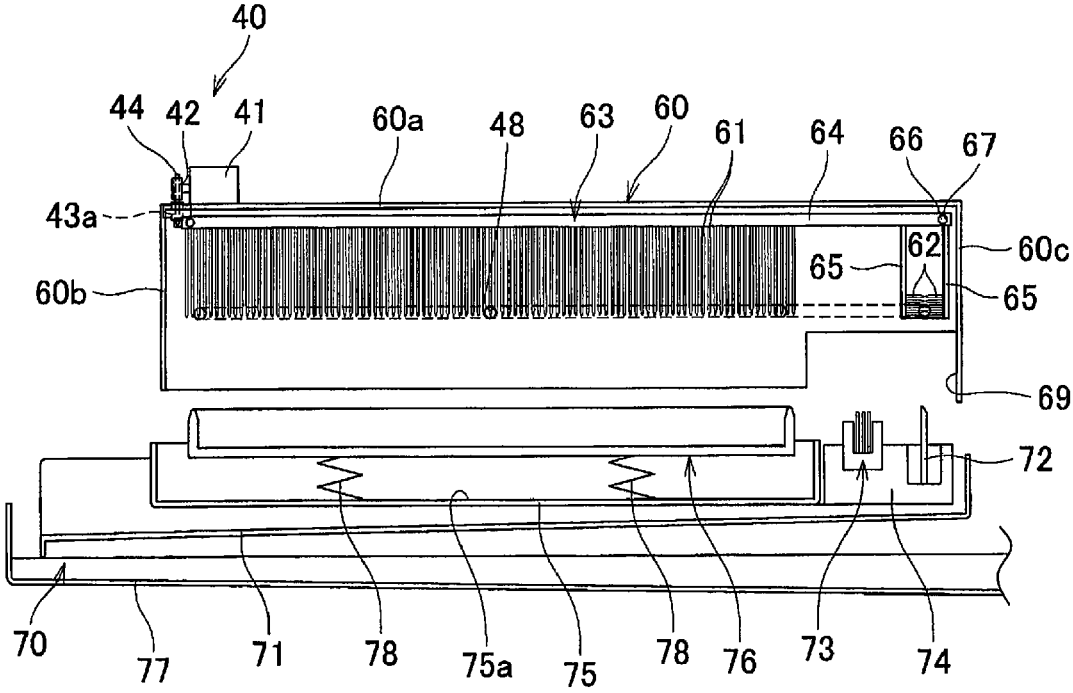
FIG. 13B shows a state where the covering is in a retracted position.
Figure 14:
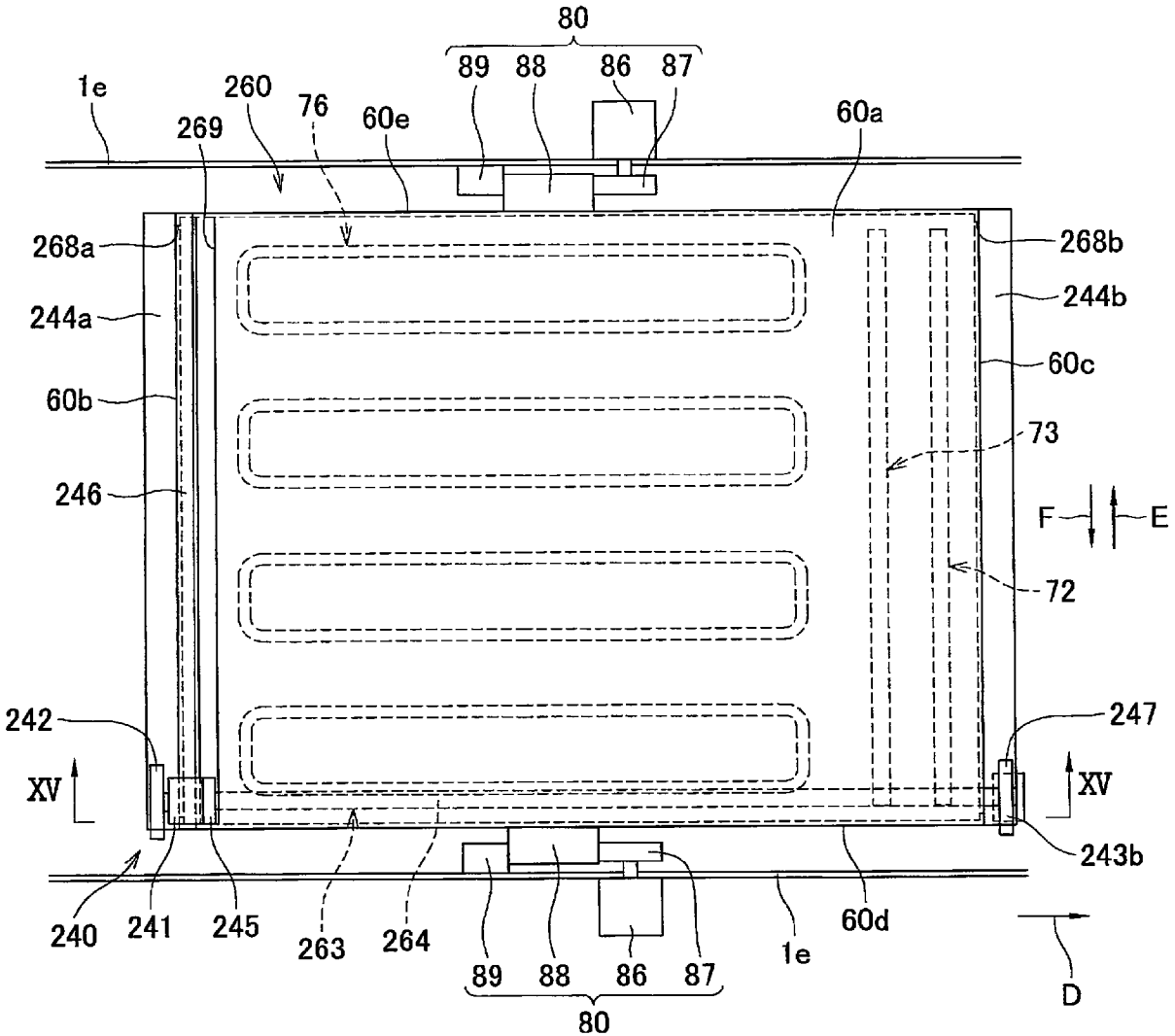
FIG. 14 is an enlarged, plan view of a covering of an inkjet printer, according to another embodiment of the present invention.
Figure 15:
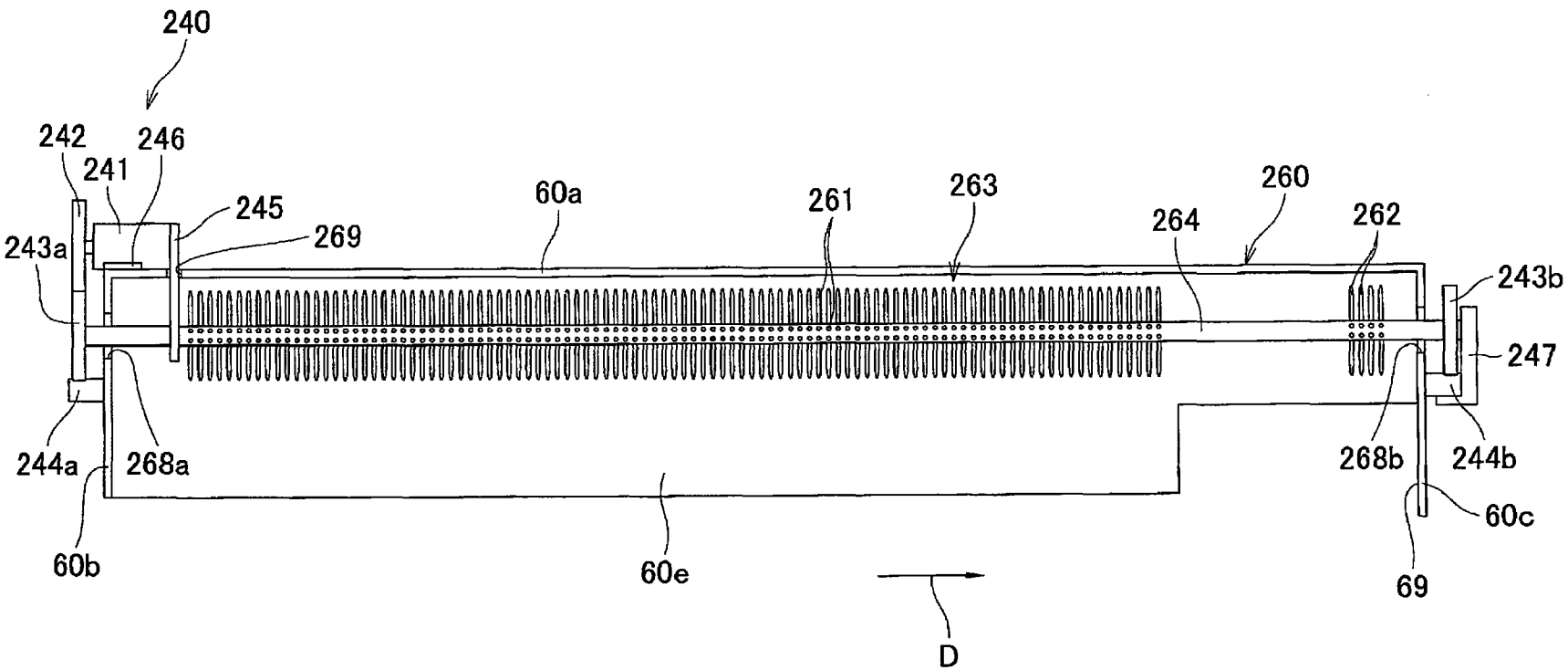
FIG. 15 is a cross-sectional view along line XV-XV in FIG. 14.
Figure 16A:
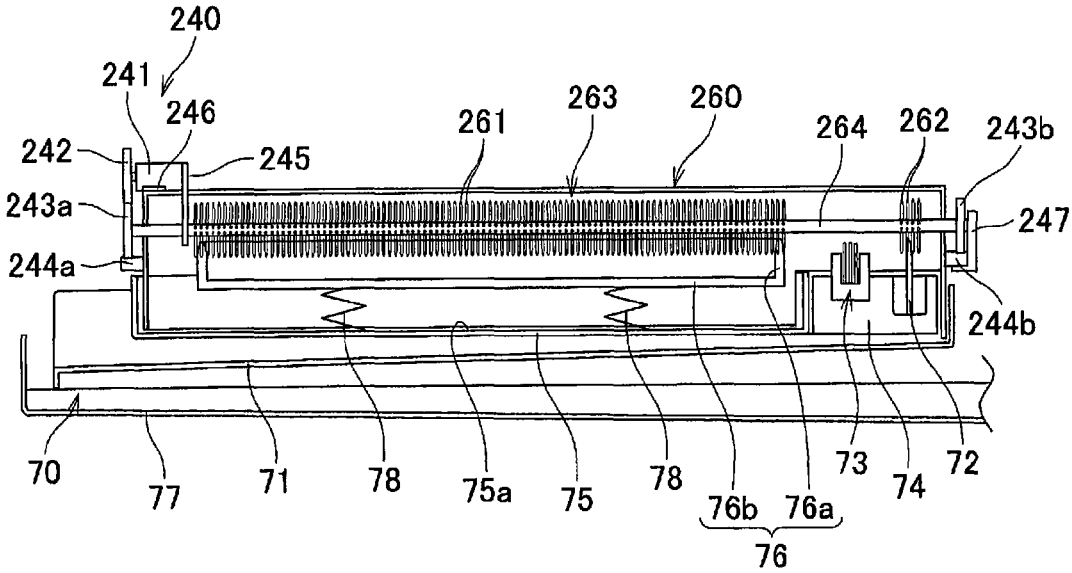
FIG. 16A shows a state where a covering of FIG. 15 is in a covering position.
Figure 16B:
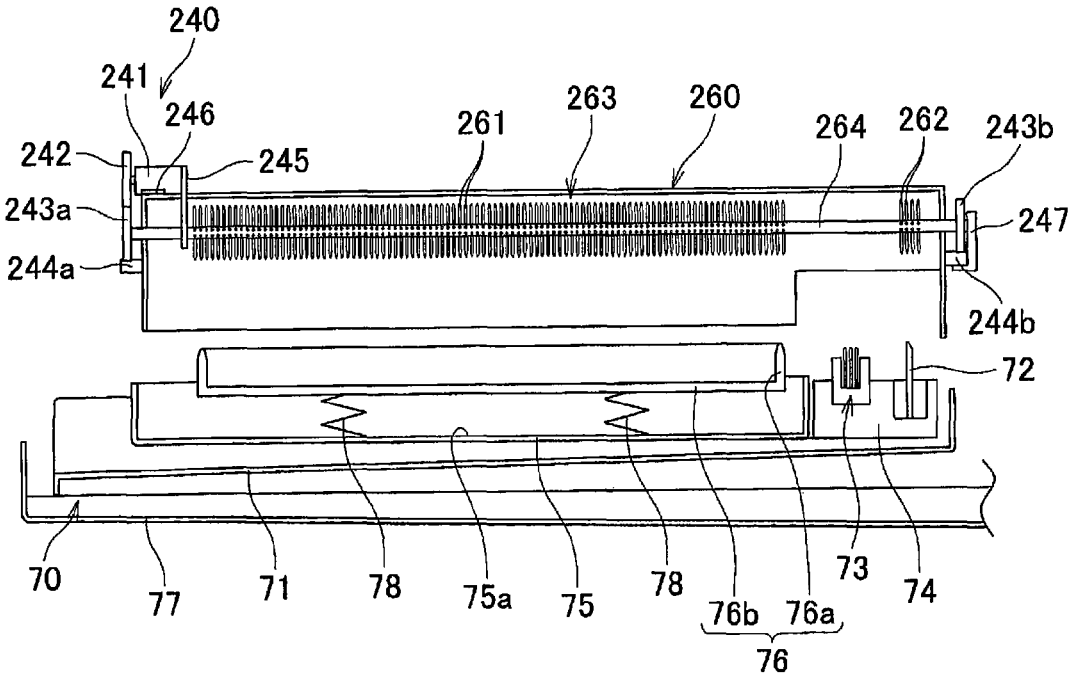
FIG. 16B shows a state where the covering of FIG. 15 is in a retracted position.
Figure 17:
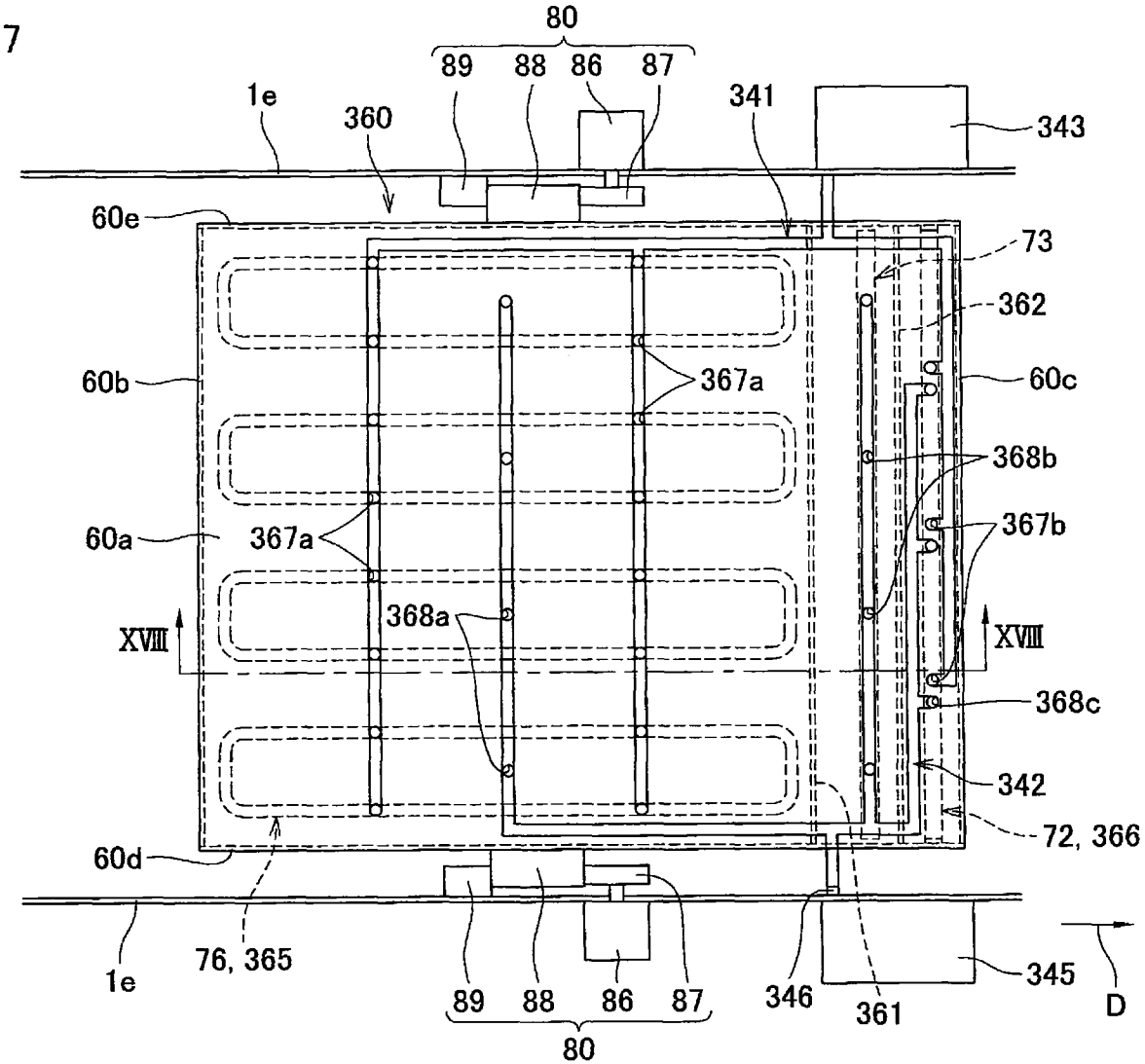
FIG. 17 is an enlarged plan view of a covering of an ink-jet printer, according to yet another embodiment of the present invention.
Figure 18:
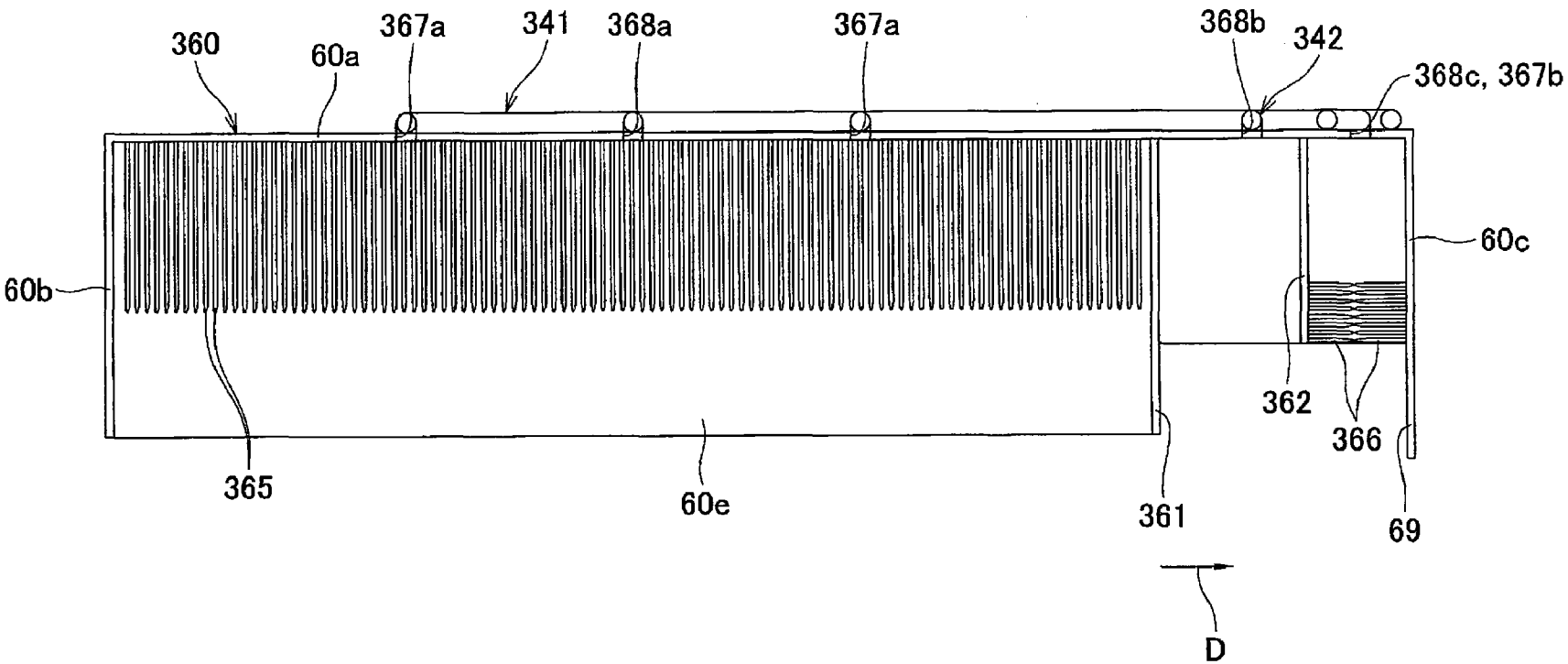
FIG. 18 is a cross-sectional view along line XVIII-XVIII in FIG. 17.

Referring FIGS. 13A and 13B, after the above-described reciprocating movement of the brush 63, the covering movement controller 115 may drive the drive motors 86 via the motor driver 128, to move the covering 60 upward from the covering position. When the covering 60 reaches the retracted position, the covering movement controller 115 may stop the two drive motors 86 via the motor driver 128. When the maintenance unit 70 is in the maintenance position the retracted position of the covering 60 may be such that a lower end of the covering 60 may not contact the distal end of the wiper 72 and the distal ends of the annular protrusions 76*a* of the caps 76. After the covering 60 is placed in the retracted position, the maintenance unit 70 may move from the retracted position to the maintenance position at which it then performs maintenance.

After the maintenance unit 70 completes maintenance and remains in the retracted position, the covering movement controller 115 may drive the drive motors 86 via the motor driver 128, to move the covering 60 downward. When the covering 60 reaches the covering position, the covering movement controller 115 may stop the drive motors 86 via the motor driver 128. At this time, the flexible needle members 61 of the brush 63 may be contact the distal end portion of the annular protrusion 76*a* closest to the side wall 60*d*, and the flexible needle members 62 may be contact the distal end portion of the wiper 72.

After the covering 60 moves from the retracted position to the covering position, the brush 63 may brush the annular protrusions 76*a* and the wiper 72. More specifically, the brush movement controller 120 may drive the motor 41 via the motor driver 130 to rotate the motor pulley 42 such that the brush 63 moves reciprocatingly. Brushing may be completed when the brush 63 returns to its original position which is the vicinity of the side wall 60*d*. By reciprocating movement of the brush 63, the distal ends of the annular protrusions 76*a* and the wiper 72 may be brushed after maintenance is performed.

The brushing operation by the brush 63 after the covering 60 moves from the retracted position to the covering position may be also performed when there is an airflow around the brush 63. That is, the airflow controller 119 may switch the switching valves 35 and 36 via the switching valve drivers 135 and 136, and may drive the blower 33 through the blower driver 129 to supply air from one of the through holes 47 and 48 into the covering 60 and draw air enclosed by the covering 60 from the other of the through holes 47 and 48.

Referring to FIGS. 14, 15, 16A, and 16B, another embodiment of an ink-jet printer is depicted. This embodiment of the present invention is substantially similar to the above-described embodiments of the present invention. Therefore, only those differences between this embodiment and the above-described embodiments are discussed with respect to this embodiment of the present invention.

In this embodiment of the present invention, a covering 260, a brush 263, and a brush movement mechanism 240 may be different than the covering 60, the brush 63, and the brush movement mechanism of the above-described embodiments of the present invention.

The covering 260 may have a box-like shape with a roof 60*a* and four side walls 60*b* to 60*e*. Long holes 268*a* and 268*b* extending along the arrow-E direction are formed in the side walls 60*b* and 60*c*, respectively. A shaft 264 of the brush 263 may pass through the holes 268*a* and 268*b*. The holes 268*a* and 268*b* may oppose each other with respect to the arrow-D direction. A long hole 269 extending along the arrow-E direction may be formed in a vicinity of an end of the roof 60*a*. Supporter 245 may pass through the long hole 269.

The brush 263 may be positioned within the covering 260. The brush 263 may comprise a cylindrical shaft 264 which extends in the arrow-D direction, and a plurality of flexible needle members 261 and 262 when extend radially from the shaft 264. The flexible needle members 261 may be positioned along the arrow-D direction in a region of the shaft 264 opposed to caps 76. The flexible needle members 261 may extend in a radial direction of the shaft 264. A length of each flexible needle member 261 may be such that the needle member 261 may contact a distal end portion of an annular protrusion 76*a* of the cap 76. The flexible needle members 262 may be positioned along the arrow-D direction in a region of the shaft 264 opposed to a wiper 72. The flexible needle members 262 may extend in a radial direction of the shaft 264. A length of each flexible needle member 262 may be such that the needle member 262 contact a distal end portion of the wiper 72.

The brush movement mechanism 240, which is mounted on the covering 260, may move in rotation the brush 263 in the arrow-E direction and the arrow-F direction. The brush movement mechanism 240 may comprise a motor 241, a motor gear 242, pinion gears 243*a* and 243*b*, rack gears 244*a* and 244*b*, a supporter 245, and a guide 246. The pinion gears 243*a* and 243*b* may be positioned to oppose respective ends of the shaft 264. The rack gears 244*a* and 244*b* may be positioned to oppose the side walls 60*b* and 60*c* to engage the pinion gears 243*a* and 243*b*, respectively. The supporter 245 may be fixed to the motor 241, and may support the shaft 264 in a rotatable manner. The guide 246 may support the motor 241 in a slidable manner.

The rack gear 244*a*, 244*b*, and the guide 246 may extend in the arrow-E direction. The pinion gear 243*a* may be fixed to an end of the shaft 264 close to the motor 241, and engaged with the motor gear 242. The pinion gear 243*b* may be fixed to the other end of the shaft 264. At the other end of the shaft 264, stopper 247 may be supported on the shaft 264. The stopper 247 may be rotatable together with the shaft 264. The stopper 247 may be an L-shaped cross section. A lower end portion of the stopper 247 extending along the arrow-D direction may be slidably contact a lower face of the rack gear 244*b*. The other end of the shaft 264 may be connected to a portion of the stopper 247 extending along the vertical direction. This may prevent the pinion gear 243*b* from falling away from the rack gear 244*b*.

Driving the motor 241 may cause the motor gear 242 to rotate and thus the pinion gear 243*a* may rotate. Thereby, the shaft 264 and the pinion gear 243*b* may also rotate, such that the pinion gears 243*a* and 243*b* may move on the rack gears 244*a* and 244*b* in an arrow-E or arrow-F direction. When the motor gear 242 rotates in the normal direction, the pinion gears 243*a* and 243*b* may move in the arrow-E direction. When the motor gear 242 rotates in the reverse direction, the pinion gears 243*a* and 243*b* may move in the arrow-F direction. In association with movement of the pinion gears 243*a* and 243*b*, the shaft 264 may move in rotation in the same direction (in the arrow-E or arrow-F direction), and the supporter 245 may also move in the same direction. Because the motor 241 may be fixed to the supporter 245, the motor 241 may move together with the supporter 245 on the guide 246.

When the maintenance unit 70 is in a retracted position, the covering 260 may be in a "covering position" at which the covering 260 covers the maintenance unit 70 from above. Before the maintenance unit 70 moves to a maintenance position, the motor 241 may be driven such that the motor gear 242 rotates in the normal direction and the brush 263 moves in rotation from a vicinity of the side wall 60*d* in the arrow-E direction. At this time, the flexible needle members 261 and 262 may move in the arrow-E direction when the shaft 264 rotate around. Therefore, distal end portions of the annular protrusions 76*a* and a distal end portion of the wiper 72 may be brushed by the flexible needle members 261 and 262.

When the brush 263 reaches a vicinity of the side wall 60*e*, the motor gear 242 may rotate in the reverse direction such that the brush 263 moves in the arrow-F direction when the blush 263 rotates in the reverse direction. When the brush 263 reaches the vicinity of the side wall 60*d*, the motor 241 may stop driving. After brushing by the brush 263 is completed, motors 86 may be driven to move the covering 260 from the covering position to the retracted position.

Referring to FIGS. 17, 18, 19A, 19B, and 20, an ink-jet printer according to another embodiment of the present invention is depicted. This embodiment of the present invention is substantially similar to the above-described embodiments of the present invention. Therefore, only those differences between this embodiment and the above-described embodiments are discussed with respect to this embodiment of the present invention.

In this embodiment, a brush provided within the covering 360 may be fixed to the covering 360. The brush of the third embodiment does not move within the covering 360. The brush of this embodiment may comprise a plurality of flexible needle members 365 and 366. Inner portion of the covering 360 may be divided into a region opposed to a wiper 72, a region opposed to an ink receiving member 73, and a region opposed to four caps 76. There may be partition walls 361 and 362 between these regions. The partition walls 361 and 362 may be in parallel with side walls 60*b* and 60*c*. Thus, the covering 360 may simultaneously and individually cover the four caps 76, the ink receiving member 73, and the wiper 72, respectively.

In a region of a lower face of the roof 60*a* between the side wall 60*b* and the partition wall 361, a plurality of flexible needle members 365 may extend downward. The flexible needle members 365 may be positioned in an annular region of the lower face of the roof 60*a*. The annular region may oppose an annular protrusion 76*a* of the cap 76. A length of each flexible needle member 365 may be such that, when the covering 360 covers a maintenance unit 70, the needle member 365 contacts with the annular protrusion 76*a* of the cap 76. On a face of the side wall 60*c* facing the partition wall 362, there may be a plurality of flexible needle members 366 in a lower end portion. The flexible needle members 366 may extend toward the partition wall 362. On a face of the partition wall 362 facing the side wall 60*c*, there may be a plurality of flexible needle members 366 in a lower end portion. The flexible needle members 366 may extend toward the side wall 60*c*. When the covering 360 is covering the maintenance unit 70, the flexible needle members 366 may sandwich the wiper 72 therebetween.

The roof 60*a* may comprise cleaning-liquid supply ports 367*a* and 367*b*, and air supply ports 368*a*, 368*b*, and 368*c*. The cleaning-liquid supply ports 367*a* may formed in regions opposed to the annular protrusions 76*a* of the caps 76. The cleaning-liquid supply ports 367*a* may be positioned for one annular protrusion 76*a*. The cleaning-liquid supply ports 367*b* may be positioned in a region opposed to the wiper 72. The air supply ports 368*a* may be formed in regions opposed to centers of the respective caps 76. The air supply ports 368*b* may be formed in a region opposed to the ink receiving member 73. The air supply ports 368*c* may be formed in the region opposed to the wiper 72.

A pipe 341 and a pipe 342 may be positioned on the roof 60*a*. The pipe 341 may be connected to the cleaning-liquid supply ports 367*a* and 367*b*. The pipe 342 may be connected to the air supply ports 368*a* to 368*c*. The pipe 341 may be connected to a pump 343 which is fixed to a main frame 1*e*. By driving the pump 343, cleaning liquid such as pure water stored in a tank may be through the pipe 341 and the cleaning-liquid supply ports 367*a* and 367*b*, poured on the annular protrusions 76*a* of the caps 76 and the wiper 72. The pipe 342 may be connected to a blower 345 with a filter 346 therebetween. The blower 345 may be fixed to the main frame 1*e*. By driving the blower 345, a flow of air fed by the blower 345 and filtered through the filter 346 may be delivered through the pipe 342 and the air supply ports 368*a* to 368*c* to the caps 76, the ink receiving member 73, and the wiper 72.

Figure 20:
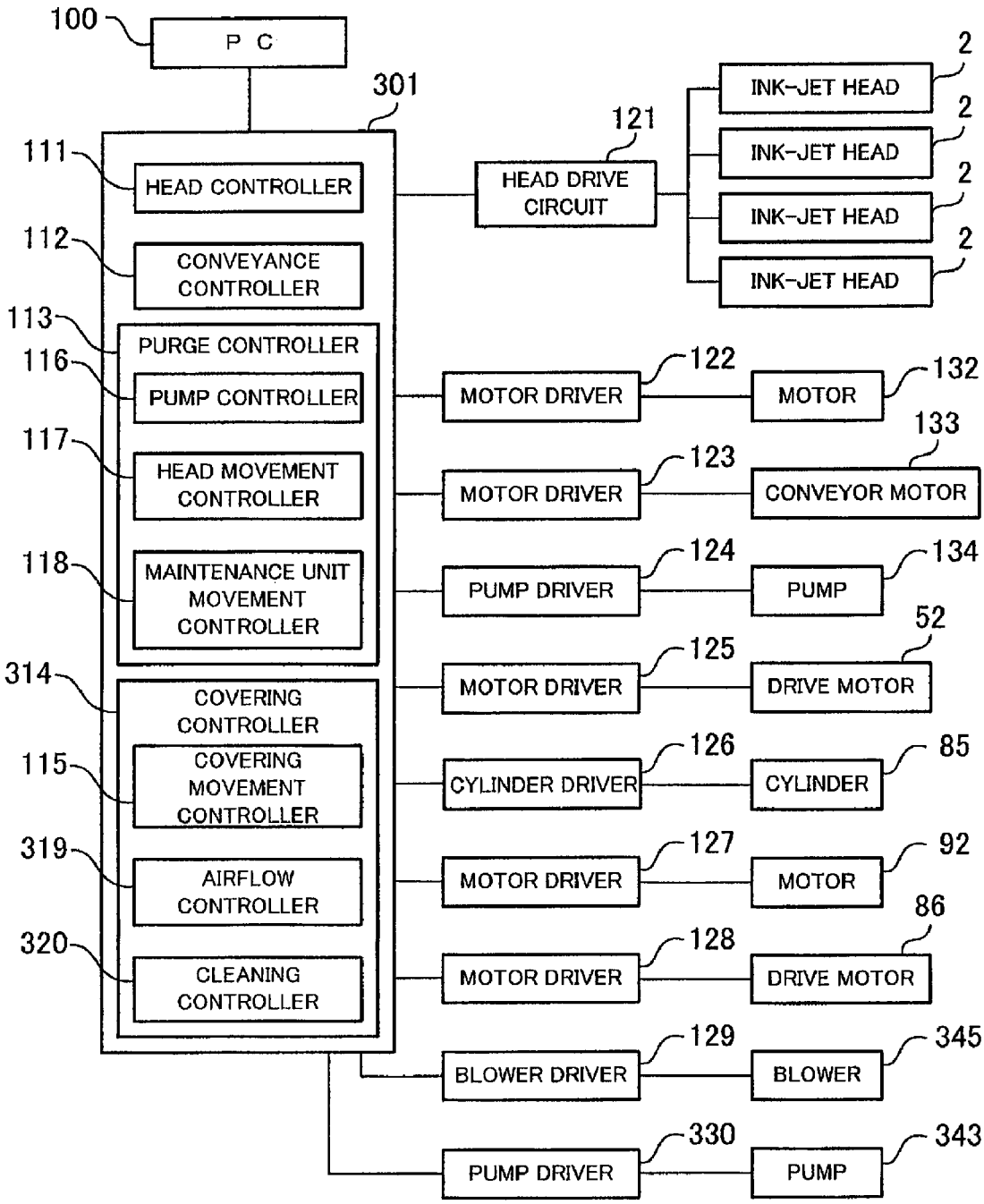
FIG. 20 is a schematic block diagram of a control system of the ink-jet printer of FIG. 17.

Referring to FIG. 20, a controller 301 comprised in the ink-jet printer of this embodiment may comprise the same component as in the first embodiment, except that its covering controller 314 is constructed differently from the covering controller 114. The covering controller 314 may comprise a covering movement controller 115 which is the same as in the first embodiment, and an airflow controller 319 which is constructed differently from the airflow controller 119 of the first embodiment. The covering controller 314 may also comprise a cleaning controller 320 instead of the brush movement controller 120 of the first embodiment. The airflow controller 319 controls a blower driver 129 connected to the blower 345.

When the covering 360 moves from the covering position to the retracted position and when the covering 360 moves from the retracted position to the covering position, the airflow controller 319 may control the blower driver 129 to drive the blower 345 such that an airflow filtered through the filter 346 is supplied through the air supply ports 368*a* to 368*c* into the covering 360. When the covering 360 moves from the covering position to the retracted position and when the covering 360 moves from the retracted position to the covering position, the cleaning controller 320 may control a pump driver 330 to drive the pump 343 such that cleaning liquid is supplied through the cleaning liquid supply ports 367*a* and 367*b* into the covering 360.

Figure 19A:
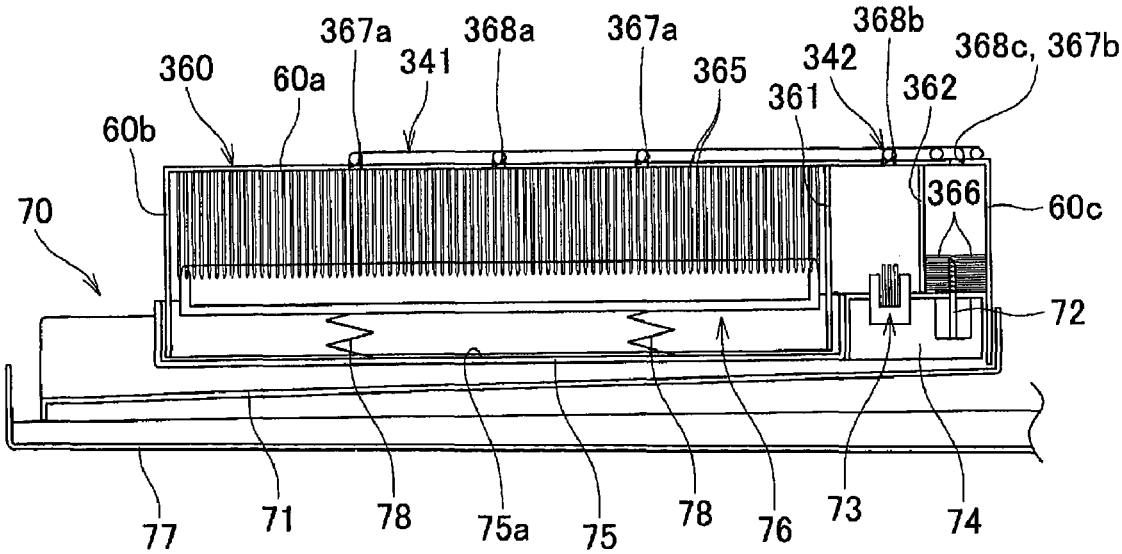
FIG. 19A shows a state where a covering of FIG. 17 is in a covering position.
Figure 19B:
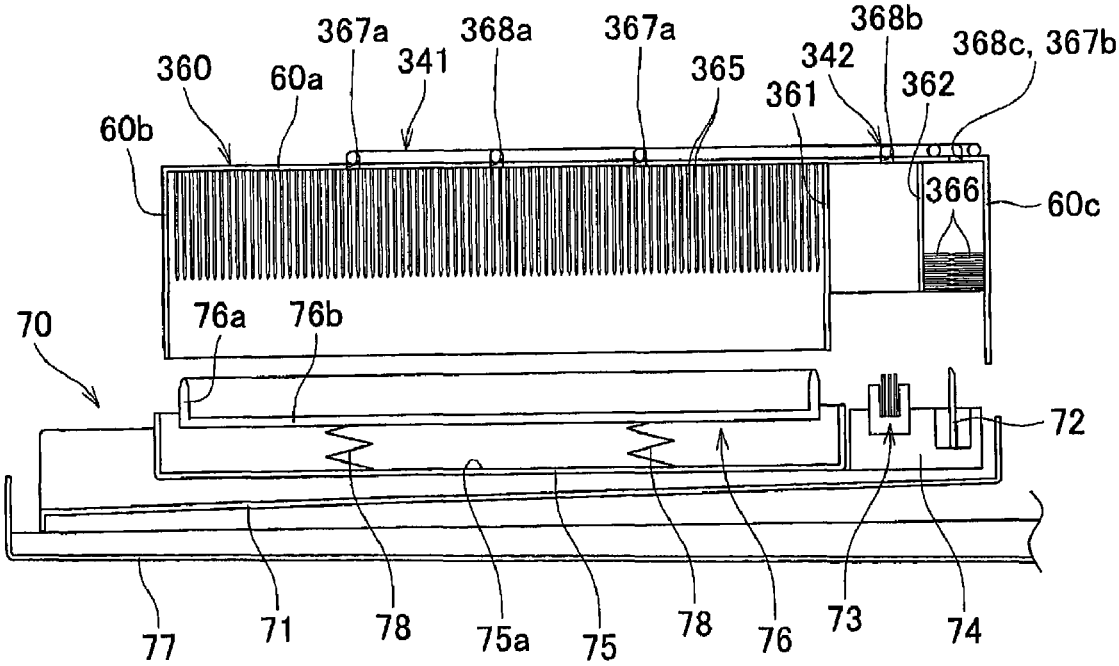
FIG. 19B shows a state where the covering of FIG. 17 is in a retracted position.

Referring to FIG. 19A, when the maintenance unit 70 is in a retracted position, the covering 360 may be in a "covering position" at which the covering 360 covers the maintenance unit 70 from above. Before the maintenance unit 70 moves to a maintenance position, drive motors 86 may be driven to move the covering 360 upward. At this time, the flexible needle members 365 and 366 may contact the annular protrusions 76*a* and the wiper 72 move upward, too. By this movement, distal end portions of the annular protrusions 76*a* and the wiper 72 by the flexible needle members 365 and 366. May be brushed when the covering 360 reaches a "retracted position", the referring to FIG. 19B, drive motors 86 may be stopped. The retracted position of the covering 360 is such that, when the maintenance unit 70 is in the maintenance position, a lower end of the covering 360 may not contact the distal end of the wiper 72 and the distal ends of the annular protrusions 76*a* of the caps 76. After the covering 360 is placed in the retracted position, the maintenance unit 70 may move from the retracted position to the maintenance position at which it then performs maintenance.

When the covering 360 moves to the retracted position, the blower 345 may be driven to supply air through the air supply ports 368*a* to 368*c* into the covering 360. When the covering 360 reaches the retracted position, driving of the blower 345 may be stopped. Therefore, when the covering 360 is moving from the covering position to the retracted position, air supplied into the covering 360 may be discharged through between the covering 360 and the maintenance unit 70 to make it difficult from a foreign material to go into the covering 360 from outside.

The pump 343 may be driven and stopped at the same timings as those of the blower 345. That is, when the covering 360 moves to the retracted position, the pump 343 may be driven to supply cleaning liquid through the cleaning liquid supply ports 367*a* and 367*b* into the covering 360. When the covering 360 reaches the retracted position, driving of the pump 343 may be stopped. Due to the driving of the pump 343, cleaning liquid is poured on the annular protrusions 76*a* and the wiper 72, thereby washing away thickened ink and foreign materials adhering to the annular protrusions 76*a* and the wiper 72.

When the maintenance unit 70 having completed maintenance remains in the retracted position, the motors 86 may be driven in synchronization so as to move the covering 360 downward. When the covering 360 reaches the covering position, the drive motors 86 may be stopped. Along with such movement of the covering 360, the distal end portions of the annular protrusions 76*a* and the distal end portion of the wiper 72 may be brushed by the flexible needle members 365 and 366.

When the covering 360 moves to the covering position, the blower 345 may be driven to supply air through the air supply ports 368*a* to 368*c* into the covering 360. When the covering 360 reaches the covering position, driving of the blower 345 may be stopped. Therefore, while the covering 360 is moving from the retracted position to the covering position, air supplied into the covering 360 may be discharged through between the covering 360 and the maintenance unit 70, to make it difficult from a foreign material to go into the covering 360 from outside.

The pump 343 may be driven and stopped at the same timings as those of the blower 345. That is, when the covering 360 moves to the covering position, the pump 343 may be driven to supply cleaning liquid through the cleaning liquid supply ports 367*a* and 367*b* into the covering 360. When the covering 360 reaches the covering position, driving of the pump 343 may be stopped.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink-jet recording apparatus comprising:

an ink-jet head having an ink ejection surface which has a plurality of ink ejection ports formed therethough;

a cap comprising:

a base; and an annular protrusion which extends from the base in a protruding direction, wherein the annular protrusion has a recess formed therein, and when the annular protrusion contacts the ink ejection surface, an enclosed space is defined therebetween;

a first movement mechanism configured to move the cap toward and away from the ink-jet head in a first plane which is parallel to the ink ejection surface to selectively position the annular protrusion in a first position in which the annular protrusion opposes the ink ejection surface, and a second position in which the annular protrusion is offset from the ink ejection surface in the protruding direction; and a brush that is arranged in tandem with the ink-jet head with respect to a moving direction of the cap, the brush comprising a plurality of flexible needle members.

2. The ink-jet recording apparatus of claim 1, wherein the brush is elongated in a direction of relative movement between the cap and the ink-jet head.

3. The ink-jet recording apparatus of claim 1, further comprising a drive mechanism which drives the brush to rotate about its own axis when the cap moves relative to the ink-jet head.

4. The ink-jet recording apparatus of claim 1, further comprising a second driving mechanism configured to move at least one of the cap and the brush relative to each other when the annular protrusion is in the second position, such that the flexible needle members selectively contact and are separated from the annular protrusion.

5. The ink-jet recording apparatus of claim 4, wherein the second movement mechanism is configured to move the at least one of the brush and the cap relative to each other in a second plane which is perpendicular to the first plane.

6. The ink-jet recording apparatus of claim 4, wherein the second movement mechanism is configured to move the at least one of the brush and the cap relative to each other in a second plane which is perpendicular to the protruding direction.

7. The ink-jet recording apparatus of claim 6, wherein the second plane is perpendicular to the first plane.

8. The ink-jet recording apparatus of claim 1, further comprising a wiper, wherein when the first movement mechanism moves the cap in the first plane the first movement mechanism also moves the wiper, and when the annular protrusion is in the second position the annular protrusion and the wiper are offset from the ink ejection surface in the protruding direction, wherein when the annular protrusion is in an intermediate position between the first position and the second portion the annular protrusion is offset from the ink ejecting surface in the protruding direction and the wiper contacts the ink ejection surface to wipe the ink ejection surface.

9. The ink-jet recording apparatus of claim 8, further comprising a second driving mechanism configured to move at least one of the cap and the brush relative to each other when the annular protrusion is in the second position, such that the flexible needle members selectively contact and are separated from the annular protrusion and the wiper.

10. The ink-jet recording apparatus of claim 9, wherein the second movement mechanism is configured to move the at least one of the brush and the cap relative to each other in a second plane which is perpendicular to the first plane.

11. The ink-jet recording apparatus of claim 9, wherein the second movement mechanism is configured to move the at least one of the brush and the cap relative to each other in a second plane which is perpendicular to the protruding direction.

12. The ink-jet recording apparatus of claim 11, wherein the second plane is perpendicular to the first plane.

13. The ink-jet recording apparatus of claim 8, further comprising at least one covering which is configured to selectively accommodate the brush, the cap, and the wiper.

14. The ink-jet recording apparatus of claim 13, further comprising:

a filter for filtering air; and an airflow generation mechanism, wherein the at least one covering has a first through hole and a second through hole formed therethrough, and when the at least one covering covers the cap and the wiper the airflow generation mechanism is configured to transmit air through the filter into the first through hole and to discharge air enclosed by the at least one covering through the second through hole.

15. The ink-jet recording apparatus of claim 14, further comprising a switcher configured to alternate a state of the airflow generation mechanism from a first state in which the airflow generation mechanism transmits air through the filter into the first through hole and discharges air enclosed by the at least one covering through the second through hole, to a second state in which the airflow generation mechanism transmits air through the filter into the second through hole and discharges air enclosed by the at least one covering through the first through hole.

16. An ink-jet recording apparatus comprising:

an ink-jet head having an ink ejection surface which has a plurality of ink ejection ports formed therethough;

a cap comprising:

a base; and an annular protrusion which extends from the base in a protruding direction, wherein the annular protrusion has a recess formed therein, and when the annular protrusion contacts the ink ejection surface, an enclosed space is defined therebetween; and a wiper configured to wipe the ink ejection face;

a first movement mechanism configured to move the cap relative to the ink-jet head in a first plane which is parallel to the ink ejection surface to selectively position the annular protrusion in a first position in which the annular protrusion opposes the ink ejection surface, and a second position in which the annular protrusion and the wiper are offset from the ink ejection surface in the protruding direction, wherein when the annular protrusion is in the second position the annular protrusion and the wiper are offset from the ink ejection surface in the protruding direction, and when the annular protrusion is in an intermediate position between the first position and the second portion the annular protrusion is offset from the ink ejecting surface in the protruding direction and the wiper contacts the ink ejection surface to wipe the ink ejection surface;

at least one covering configured to selectively cover the cap and the wiper; and a second movement mechanism configured to move at least one of the cap and the covering in the protruding direction, such that the at least one covering covers the cap and the wiper when the annular protrusion is in the second position.

17. The ink-jet recording apparatus of claim 16, further comprising a controller which controls the second movement mechanism.

18. The ink-jet recording apparatus of claim 16, wherein the at least one covering comprises a first covering which selectively covers the cap and a second covering which selectively covers the wiper.

19. The ink-jet recording apparatus of claim 18, wherein the first covering is integral with the second covering.

20. The ink-jet recording apparatus of claim 16, wherein the at least one covering comprises a first plurality of flexible needle members, and when the at least one covering covers the cap the first plurality of flexible needle members contact the annular protrusion.

21. The ink-jet recording apparatus of claim 20, wherein each of the first plurality of flexible needle members extend in the protruding direction, and the flexible needle members are arranged annularly to correspond to the annular protrusion.

22. The ink-jet recording apparatus of claim 16, wherein the at least one covering comprises a second plurality of flexible needle members, and when the at least one covering covers the wiper the second plurality of flexible needle members contact the wiper.

23. The ink-jet recording apparatus of claim 22, wherein each of the second plurality of flexible needle members extend in a direction perpendicular to the protruding direction, and the second plurality of flexible needle members sandwich the wiper therebetween.

24. The ink-jet recording apparatus of claim 16, further comprising a cleaning liquid supply mechanism which selectively supplies a cleaning liquid, wherein the at least one covering has a first through hole formed therethrough at a region opposed to the annular protrusion, and the cleaning liquid supply mechanism is configured to supply the cleaning liquid to the first through hole when the at least one covering covers the cap.

25. The ink-jet recording apparatus of claim 24, wherein the at least one covering has a second through hole formed therethrough at a region opposed to the wiper, and the cleaning liquid supply mechanism is configured to supply the cleaning liquid to the first through hole when the at least one covering covers the wiper.

26. The ink-jet recording apparatus of claim 16, further comprising:

a filter for filtering air; and an airflow generation mechanism wherein the at least one covering has a third through hole formed in a region opposed to the cap, and when the at least one covering covers the cap, the airflow generation mechanism transmits an airflow through the filter to the third through hole.

27. The ink-jet recording apparatus of claim 26, the at least one covering has a fourth through hole formed in the region opposed to the wiper, and when the at least one covering is covering the wiper, the airflow generation mechanism transmits an airflow through the filter to the fourth through hole.

28. The ink-jet recording apparatus of claim 16, wherein the cap comprises an elastic material.

29. The ink-jet recording apparatus of claim 16, wherein the cap is supported by a biasing member.

* * * * *